US005784047A

United States Patent [19]

Cahill, III et al.

[11] Patent Number: 5,784,047

[45] Date of Patent: Jul. 21, 1998

[54] METHOD AND APPARATUS FOR A DISPLAY SCALER

[75] Inventors: Benjamin M. Cahill, III, Ringoes, N.J.; Anthony Paul Bertapelli, Phoenix, Ariz.; Tim N. Hanna, Ann Arbor, Mich.

[73] Assignee: Intel Corporation, Santa Clara, Calif.

[21] Appl. No.: 431,408

[22] Filed: Apr. 28, 1995

[51] Int. Cl.[6] ..... G09G 5/00

[52] U.S. Cl. ..... 345/127; 345/202

[58] Field of Search ..... 345/119, 120, 345/127, 131, 132, 202, 128, 129, 130

[56] References Cited

U.S. PATENT DOCUMENTS

| | | | |
|---|---|---|---|
| 3,588,872 | 6/1971 | Kolb | 345/130 |
| 3,921,164 | 11/1975 | Anderson | 345/132 |
| 4,528,693 | 7/1985 | Pearson et al. | 345/127 |
| 4,610,026 | 9/1986 | Tabata et al. | 345/131 |
| 4,751,507 | 6/1988 | Hama et al. | 345/131 |
| 4,814,884 | 3/1989 | Johnson et al. | 345/120 |
| 4,862,389 | 8/1989 | Takagi | 345/119 |
| 4,942,619 | 7/1990 | Takagi et al. | 382/47 |
| 5,068,648 | 11/1991 | Chiba | 345/200 |
| 5,068,905 | 11/1991 | Hackett et al. | 345/132 |
| 5,081,450 | 1/1992 | Lucas et al. | 340/728 |
| 5,227,771 | 7/1993 | Kerr et al. | 345/119 |
| 5,245,678 | 9/1993 | Eschbach et al. | 382/50 |
| 5,245,702 | 9/1993 | McIntyre et al. | 345/119 |
| 5,276,437 | 1/1994 | Horvath et al. | 345/119 |
| 5,327,158 | 7/1994 | Takahashi et al. | 345/127 |
| 5,334,296 | 8/1994 | Larkin et al. | 345/127 |
| 5,334,994 | 8/1994 | Takagi | 345/120 |
| 5,369,617 | 11/1994 | Munson | 365/219 |
| 5,384,735 | 1/1995 | Park et al. | 365/189.05 |
| 5,457,580 | 10/1995 | Yoo | 360/36.2 |
| 5,469,223 | 11/1995 | Kimura | 348/581 |
| 5,572,655 | 11/1996 | Tuljapurkar et al. | 395/788 |

*Primary Examiner*—Chanh Nguyen

*Attorney, Agent, or Firm*—Blakely, Sokoloff, Taylor & Zafman

[57] ABSTRACT

A display scaler of the present invention typically includes (a) a memory for sending data, (b) a first variable length buffer for receiving the data from the memory, (c) a first scaler for scaling the data in a first direction, (d) a buffer controller for controlling the first buffer, (e) a memory controller for controlling sending of the data from the memory to the first variable length buffer, and (f) a main display controller for sending control signals to the first scaler, the buffer controller, and the memory controller. The display scaler may further include (g) a second buffer for receiving the scaled data from the first scaler and (h) a second scaler for scaling the scaled data in a second direction. The present invention provides a method of generating a first image on a first display window and a second image on a second display window. The method may include the steps of: (a) sending first data corresponding to a portion of the first image; (b) storing the first data in a first storage; (c) sending second data corresponding to a portion of the second image; (d) storing the second data in a second storage; (e) scaling some of the first data vertically and horizontally; (f) transmitting the scaled first data for display; (g) scaling some of the second data vertically and horizontally; and (h) transmitting the scaled second data for display.

26 Claims, 31 Drawing Sheets

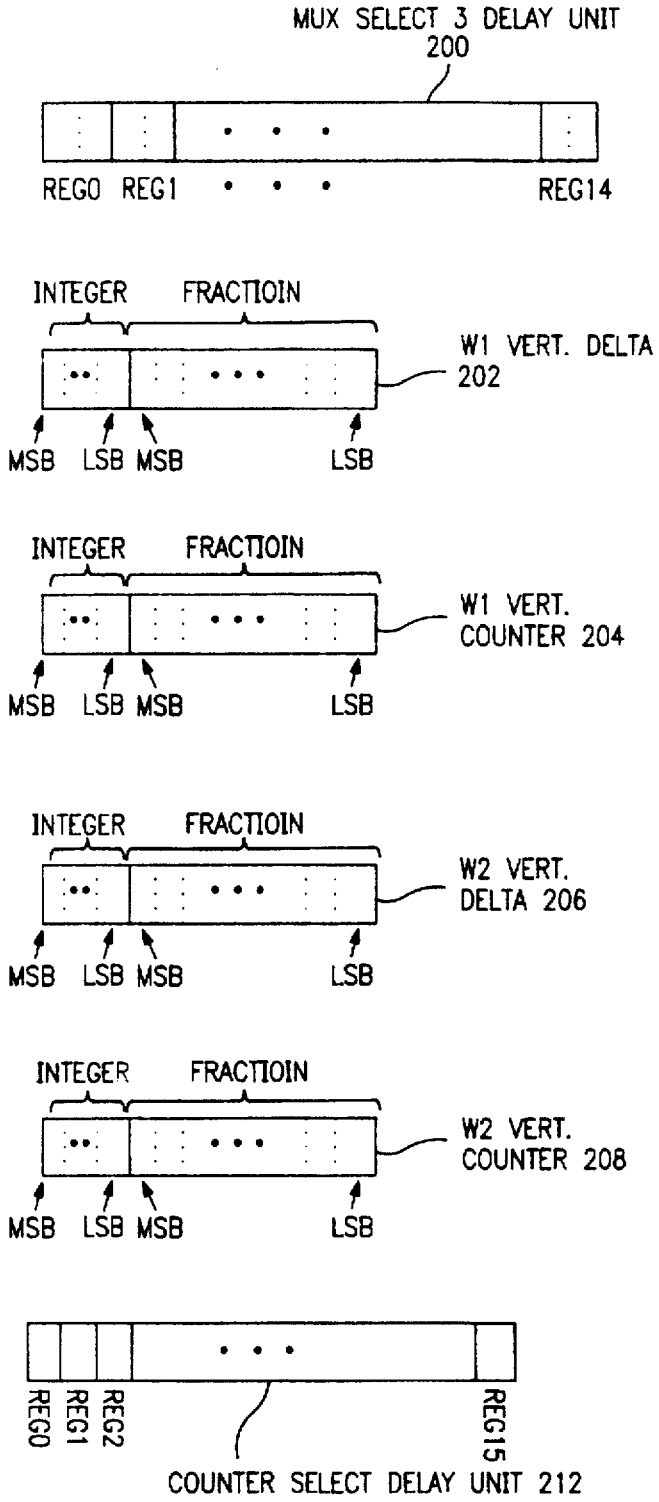
FIG. 6B-I

| INPUT | | | OUTPUT | | | | |
|---|---|---|---|---|---|---|---|
| LOAD 324 | SHIFT 258 | PFCNT 404 | REG ENBL 1 | MUX SEL1 | REG. ENBL 2 | MUX SEL 2 | REG. ENBL 3 |
| 0 | 0 | 00 | 0 | 0 | 0 | =1 IF (LOAD=1 AND PF2 DIRECT =1) OR (LOAD=1 AND PFCNT=00). OTHERWISE, =0 | =1 IF (LOAD=1 AND PF2 DIRECT =1) OR SHIFT=1 OTHERWISE, =0 |
| 0 | 0 | 01 | 0 | 0 | 0 | | |
| 0 | 0 | 10 | 0 | 0 | 0 | | |
| 0 | 0 | 11 | 0 | 0 | 0 | | |
| 0 | 1 | 00 | 0 | 0 | 0 | | |
| 0 | 1 | 01 | 0 | 0 | 0 | | |
| 0 | 1 | 10 | 0 | 0 | 1 | | |
| 0 | 1 | 11 | 0 | 0 | 0 | | |
| 1 | 0 | 00 | 0 | 1 | 1 | | |
| 1 | 0 | 01 | 1 | 0 | 0 | | |
| 1 | 0 | 10 | 0 | 0 | 0 | | |
| 1 | 0 | 11 | 0 | 0 | 0 | | |
| 1 | 1 | 00 | 0 | 0 | 0 | | |
| 1 | 1 | 01 | 0 | 1 | 1 | | |
| 1 | 1 | 10 | 1 | 0 | 1 | | |
| 1 | 1 | 11 | 0 | 0 | 0 | | |

FIG. 14

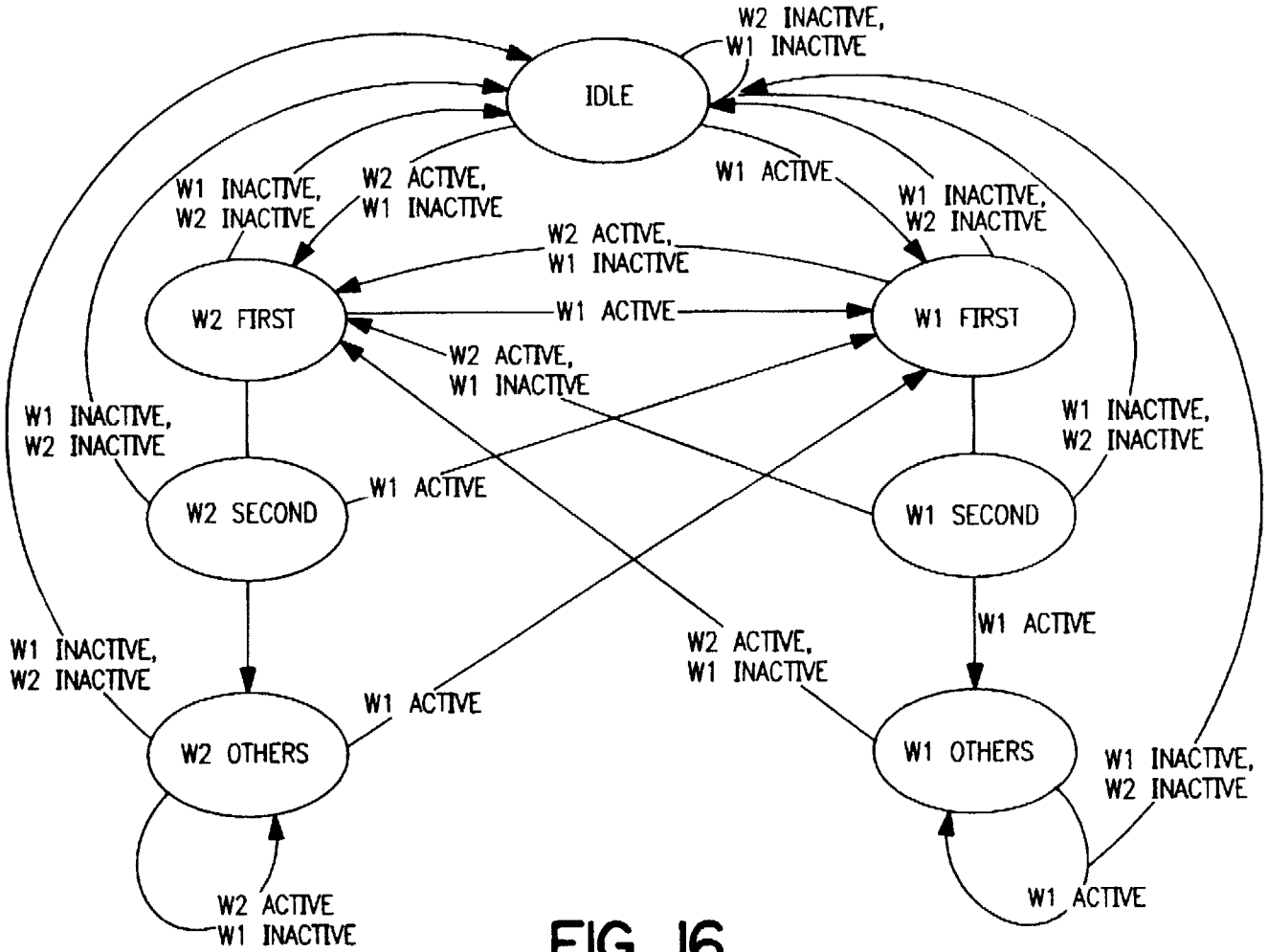
IDLE
W1 FIRST
W1 SECOND
W1 OTHERS
W2 FIRST
W2 SECOND
W2 OTHERS
W2 INACTIVE, W1 INACTIVE
W1 ACTIVE
W1 INACTIVE, W2 INACTIVE
W2

MUXSEL 4 = { 0 REQ602 → REQ 606
VERT. SCALER → REQ 606
OUTPUT }

REGENBL 4 = { 0 NO ACTION
1 REQ 602, REQ 606 LOAD }

NEWBYTE = { 1 IF INTEGER LSB OF W1 HORIZ. COUNTER 218 FOR THIS CYCLE IS DIFFERENT FROM THE PREVIOUS ONE, AND W1 IS BEING DISPLAYED
OR
1 IF INTEGER LSB OF W2 HORIZ. COUNTER 222 FOR THIS CYCLE IS DIFFERENT FROM THE PREVIOUS ONE, AND W2 IS BEING DISPLAYED. }

IDLE – ALL SIGNALS INACTIVE
W1 FIRST – MUXSEL 4 = 1
REGENBL 4 = 1

W1 SECOND – MUXSEL 4 = 0
REGENBL 4 = 1

W1 OTHERS – MUXSEL 4 = 0
REGENBL 4 = NEWBYTE

W2 FIRST – MUXSEL 4 = 1
REGENBL 4 = 1

W2 SECOND – MUXSEL 4 = 0
REGENBL 4 = 1

W2 OTHERS – MUXSEL 4 = 0
REGENBL 4 = NEWBYTE

FIG. 17A

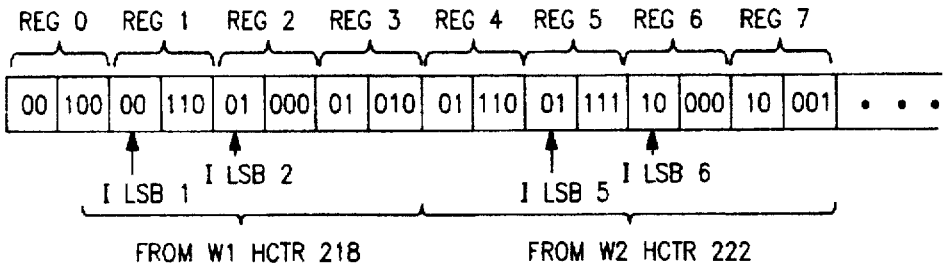

FIG. 17B

| | W1 VDELTA 202 | | W1 VCTR 204 | | W1 MDELTA 216 | | W1 HCTR 218 | |
|---|---|---|---|---|---|---|---|---|
| | I | F | I | F | I | F | I | F |
| $P^1_{0,0}$ | 0 | 1/4 | 0 | 0 | 0 | 1/2 | 0 | 0 |
| $P^1_{0,1}$ | 0 | 1/4 | 0 | 0 | 0 | 1/2 | 0 | 1/2 |
| $P^1_{0,2}$ | 0 | 1/4 | 0 | 0 | 0 | 1/2 | 1 | 0 |
| $P^1_{0,3}$ | 0 | 1/4 | 0 | 0 | 0 | 1/2 | 1 | 1/2 |
| ⋮ | | | | | | | | |
| $P^1_{1,0}$ | 0 | 1/4 | 0 | 1/4 | 0 | 1/2 | 0 | 0 |
| $P^1_{1,1}$ | 0 | 1/4 | 0 | 1/4 | 0 | 1/2 | 0 | 1/2 |
| $P^1_{1,2}$ | 0 | 1/4 | 0 | 1/4 | 0 | 1/2 | 1 | 0 |
| $P^1_{1,3}$ | 0 | 1/4 | 0 | 1/4 | 0 | 1/2 | 1 | 1/2 |
| ⋮ | | | | | | | | |
| $P^1_{2,4}$ | 0 | 1/4 | 0 | 1/2 | 0 | 1/2 | 2 | 0 |
| $P^1_{2,5}$ | 0 | 1/4 | 0 | 1/2 | 0 | 1/2 | 2 | 1/2 |
| $P^1_{2,6}$ | 0 | 1/4 | 0 | 1/2 | 0 | 1/2 | 3 | 0 |
| $P^1_{2,7}$ | 0 | 1/4 | 0 | 1/2 | 0 | 1/2 | 3 | 1/2 |
| ⋮ | | | | | | | | |
| $P^1_{3,0}$ | 0 | 1/4 | 0 | 3/4 | 0 | 1/2 | 0 | 0 |
| $P^1_{3,1}$ | 0 | 1/4 | 0 | 3/4 | 0 | 1/2 | 0 | 1/2 |
| $P^1_{3,2}$ | 0 | 1/4 | 0 | 3/4 | 0 | 1/2 | 1 | 0 |
| $P^1_{3,3}$ | 0 | 1/4 | 0 | 3/4 | 0 | 1/2 | 1 | 1/2 |
| ⋮ | | | | | | | | |
| $P^1_{4,0}$ | 0 | 1/4 | 1 | 0 | 0 | 1/2 | 0 | 0 |
| $P^1_{4,1}$ | 0 | 1/4 | 1 | 0 | 0 | 1/2 | 0 | 1/2 |
| $P^1_{4,2}$ | 0 | 1/4 | 1 | 0 | 0 | 1/2 | 1 | 0 |
| $P^1_{4,3}$ | 0 | 1/4 | 1 | 0 | 0 | 1/2 | 1 | 1/2 |

FIG. 20

METHOD AND APPARATUS FOR A DISPLAY SCALER

BACKGROUND OF THE INVENTION

1. Field of the Invention

The present invention relates to image signal processing, and, in particular, to systems for scaling and displaying digital images.

2. Description of Related Art

A video system that is capable of scaling and displaying motion video images in real time preferably supports a variety of operating modes such as pass-through and video conferencing modes. In a pass-through mode, a video generator (e.g., a video camera) generates video images that can be processed by a video system for real-time display on a display monitor. In a video conferencing mode, the video images captured at one end of the communication are compressed by a first video system at that end in real-time and sent to the other end of the communication. Upon receiving, a second video system at the other end decompresses and processes the video images for display on a display monitor.

The video systems described above are preferably capable of displaying video images onto specified windows on the display screen. This typically involves scaling and positioning all or part of the display image into the desired display window. The video systems also preferably support the merging of video images with images from graphics processors, such as an IBM Video Graphics Array (VGA) processor or a VGA compatible processor.

Referring now to FIG. 1, there is shown a block diagram of a conventional video system 100 that performs the above-described functions. Video system 100 includes a host processor and memory 102, a mass storage device 104, a modem 105, a bus 114, a video generator 106, a video subsystem 108, a graphics processor 112, and a display monitor 110. Video system 100 can operate in the pass-through or video conferencing mode. In the pass-through mode, video signals generated by video generator 106 are processed by video subsystem 108 for display on display monitor 110. In the video conferencing mode, video images captured at one end of the communication are compressed and sent to the other end (e.g., video system 100) via a communication network such as telephones and modems. When video system 100 receives the video images through modem 105, video subsystem 108 decompresses the images for display on display monitor 110.

Referring now to FIG. 2, there is shown a block diagram of video subsystem 108 of video system 100. Video subsystem 108 includes a video decoder/digitizer 202, a capture/VRAM controller 204, a pixel processor 206, a host interface 214, a subsystem bus 216, a video random access memory (VRAM) 208, a display processor 210, a video/graphics merger 212, a keying/audio processor 220, and an audio processor 218.

In the pass-through mode, video decoder/digitizer 202 receives an analog video signal from video generator 106 of FIG. 1, decodes the analog video signal into three linear components (e.g., a luminance Y component and two chrominance U and V components), and digitizes each of the three linear component signals. The digitized data is then captured and stored into dualport VRAM 208 by capture/VRAM controller 204 via subsystem bus 216.

Pixel processor 206 then accesses the video data stored in VRAM 208, scales the data for display in the desired window of the display screen, and stores the scaled data back to VRAM 208. Display processor 210 then accesses the scaled bitmap data in VRAM 208 to generate video data for transmission to video/graphics merger 212, which optionally merges the video data with images from graphics processor 112 of FIG. 1 for display on display monitor 110.

In the video conferencing mode, the compressed video data received from the other side is stored in VRAM 208. Pixel processor 206 then accesses the compressed data stored in VRAM 208, decompresses the compressed data, and stores a decompressed bitmap back to VRAM 208. Pixel processor 206 then accesses the decompressed bitmap data in VRAM 208, scales the decompressed data for display, and stores a scaled bitmap back to VRAM 208. Display processor 210 then accesses the scaled bitmap data in VRAM 208 to generate video data for transmission to video/graphics merger 212, which optionally merges the video data with images from graphics processor 112 of FIG. 1 for display on display monitor 110.

Although video subsystem 108 provides the above-described operating modes and functions, it still has certain limitations. First of all, video subsystem 108 does not provide the ability to operate components having substantially different operating frequencies. For example, a video memory operating at 50 MHz cannot be used with a display processor operating at 80 MHz. Second, video subsystem 108 does not provide a hardware approach to display overlapping display windows or to display any number of bytes in the overlapping display windows.

Third, video subsystem 108 creates and stores complete scaled bitmaps to memory (i.e., VRAM 208) before displaying the scaled data. Those scaled bitmaps contain background pixels that are outside the active video window pixel region (i.e., the region corresponding to actual video data). Fourth, the display scaling implemented by video subsystem 108 is not continuously variable in both horizontal and vertical dimensions. Fifth, video subsystem 108 does not provide display scaling with interpolation of all three video components in both the vertical and horizontal dimensions. This is due, in part, to the fact that the pixel processor of video subsystem 108 does not have the bandwidth to interpolate as it performs the copy/scale function. Nor does pixel processor 206 have the bandwidth to scale up during normal processing rates of 30 frames per second.

Sixth, video subsystem 108 requires not only display processor 210 but also three gate arrays (capture/VRAM controller 204, host interface 214, and keying/audio processor 220). Lastly, to meet the data bandwidth requirements for video system 100, video subsystem 108 requires high speed RAMs such as VRAM 208. Less expensive memories such as a DRAM can not meet the bandwidth requirement. To store separate and entire bit streams for the compressed video data, bitmaps for the decompressed video data, and the scaled video data, video subsystem 108 requires a substantially large amount of memory. Video subsystem 108 typically contains two megabytes of dual-port VRAM 208.

Therefore, it is desirable to provide a video system for scaling and displaying video images in real time that can utilize components having different operating frequencies. Memory is typically the slowest component, and slows down the overall system speed. If all components need to be operated at the same speed, then the speeds of the various components of the video system are limited to the speed of the memory. However, if components having higher operating frequencies can operate on memories having slower access frequency, then the overall system performance will be enhanced.

In addition, having the capability of displaying any number of bytes in overlapping display windows is useful in a video system. Also, having a hardware approach to displaying overlapping display windows will increase the performance of the video system.

Furthermore, it is desirable not to create and store complete scaled bitmaps to memory before displaying the scaled data. Such a video system preferably scales only pixel data corresponding to the active video window pixel region. In addition, the display scaling implemented by the video system is preferably continuously variable in both vertical and horizontal dimensions.

Moreover, the video system preferably provides display scaling with interpolation of all three video components in both the vertical and horizontal dimensions at normal processing rates of 30 frames per second. Furthermore, it is desirable for the video system not to require multiple gate arrays and a display processor. It is also desirable that the video system can use a slower memory which is less expensive and not have a large dual-port memory device.

SUMMARY OF THE INVENTION

A display scaler of the present invention typically includes (a) a memory for sending data, (b) a first variable length buffer coupled to the memory for receiving the data from the memory, (c) a first scaler coupled to the first buffer for scaling the data in a first direction, (d) a buffer controller coupled to the first buffer for controlling the first buffer, (e) a memory controller coupled to the memory for controlling sending of the data from the memory to the first variable length buffer, and (f) a main display controller coupled to the first scaler, the buffer controller, and the memory controller for sending control signals to the first scaler, the buffer controller, and the memory controller.

The display scaler may further include (g) a second buffer for receiving the scaled data from the first scaler and (h) a second scaler for scaling the scaled data in a second direction where the main display controller is coupled to the second scaler.

The first buffer may include a first, a second, a third, a fourth, a fifth, a sixth, a seventh and an eighth register and a first, a second, a third, a fourth, a fifth, and a sixth multiplexer. The first multiplexer is coupled between the first and third registers for selecting an input from the memory or the third register; the second multiplexer is coupled between the second and fourth registers for selecting an input from the memory or from the fourth register; the third multiplexer is coupled between the third and fifth registers for selecting an input from the memory or from the fifth register; the fourth multiplexer is coupled between the fourth and sixth registers for selecting an input from the memory or from the sixth register; the fifth multiplexer is coupled to the first register for selecting an input among data in the first register; the sixth multiplexer is coupled to the second register for selecting an input among data in the second register; the seventh register is for receiving an output from the fifth multiplexer; and the eighth register is for receiving an output from the sixth multiplexer. The first buffer may be coupled to the memory through dual lines.

The first scaler may include means for supplying a first weight to a first output of the first buffer and a second weight to a second output of the first buffer simultaneously and an adder for adding the weighted first and second outputs.

The second buffer may include a second storage for receiving first or second data from the first scaler, a first storage for receiving the first data from the first scaler or for receiving the second data from the second storage, and a multiplexer coupled between the first scaler and the first storage for selecting an input from the first scaler or from the second storage.

The second scaler may include means for receiving first and second outputs of the second buffer simultaneously, means for simultaneously supplying a weight to the first output of the second buffer and a weight to the second output of the second buffer, and an adder for adding the weighted first and second outputs.

The buffer controller may include a buffer counter and a buffer logic unit for receiving inputs from the buffer counter, the memory controller, and the main display controller and for sending outputs to the first buffer.

The memory controller may include first-in-first-out (FIFO) registers for receiving inputs from the main display controller and a read memory controller for receiving inputs from the FIFO registers and for sending outputs to the memory and to the first buffer.

The main display controller may include a main logic unit for sending outputs to the memory controller and a plurality of counters, multiplexers and delay units.

According to one embodiment of the present invention, the first variable length buffer is a variable length first-in-first-out prefetch buffer, the first scaler is a vertical scaler, the second scaler is a horizontal scaler, the first direction is a vertical direction, and the second direction is a horizontal direction.

The present invention provides a method of generating a first image on a first display window and a second image on a second display window, where the first and second display windows are for being displayed on a display unit. The method may include the steps of: (a) sending first data corresponding to a portion of the first image; (b) storing the first data in a first storage; (c) sending second data corresponding to a portion of the second image; (d) storing the second data in a second storage; (e) scaling some of the first data vertically and horizontally; (f) transmitting the scaled first data for display; (g) scaling some of the second data vertically and horizontally; and (h) transmitting the scaled second data for display.

Furthermore, the present invention provides a method of generating an image including the steps of: (a) sending in parallel first and second data corresponding to a portion of the image; (b) storing the first data in a first storage and the second data in a second storage simultaneously; (c) scaling a portion of the first data and a portion of second data vertically and horizontally; and (d) transmitting the scaled data for display.

BRIEF DESCRIPTION OF THE DRAWINGS

The features, aspects, and advantages of the present invention will become more fully apparent from the following detailed description, appended claims, and accompanying drawings in which:

FIG. 14 is a table illustrating the input and output signals of the prefetch logic unit of FIG. 8;

FIG. 16 is a state diagram of the advance state machine in FIG. 6*a;*

FIG. 17*a* is a table describing the states shown in FIG. 16;

FIG. 17*b* shows an example of the contents of the counter delay unit in FIG. 6*a*.

FIG. 20 presents vertical delta, vertical counter, horizontal delta, and horizontal counter values during scaling according to the present invention;

DETAILED DESCRIPTION OF THE INVENTION

In the following description, numerous specific details are set forth to provide a thorough understanding of the present invention. In some instances, one ordinarily skilled in the art may be able to practice the present invention without these specific details. In other instances, well-known circuits, registers, structures and techniques have not been shown in detail not to unnecessarily obscure the present invention.

Figure 3:
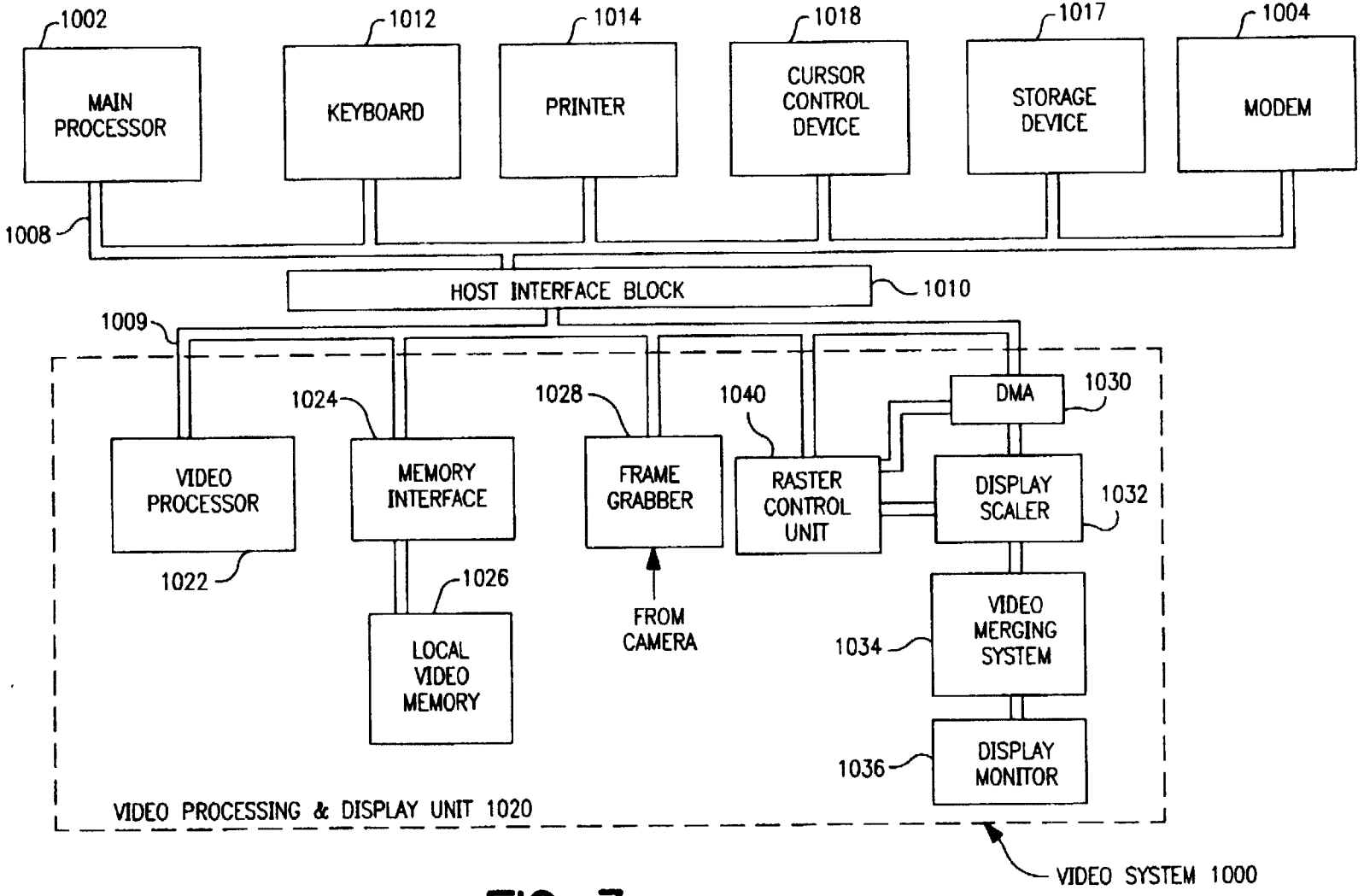
FIG. 3 is a block diagram of a video system embodying features of the present invention.

Referring first to FIG. 3, a video system 1000 may utilize a display scaler 1032 that implements the present invention. Video system 1000 includes a main processor 1002. This element is typically found in most general purpose computers and in almost all specific purpose computers. In fact, this device is intended to be representative of the broad category of data processors. Many commercially available computers having differing capabilities may be utilized which incorporate the present invention.

A system bus 1008 is provided for communicating information. Video system 1000 may also include a keyboard 1012 including alpha numeric and function keys coupled to system bus 1008 for communicating information and command selections to main processor 1002, and a cursor control device 1018 coupled to system bus 1008 for communicating user input information and command selections to main processor 1002 based on a user's hand movement. Cursor control device 1018 allows the network user to dynamically signal the two-dimensional movement of the visual symbol (pointer) on a display screen of display monitor 1036. Many implementations of cursor control device 1018 are known in the art, including a track ball, mouse, joy stick or special keys on keyboard 1012, all capable of signaling movement in a given direction or manner of the displacement.

Video system 1000 of FIG. 3 also includes a data storage device 1017 such as a magnetic disk or optical disk drive, which may be communicatively coupled with system bus 1008, for storing data and instructions. Also available for interface with video system 1000 is a printer 1014 for outputting data. In addition, a modem 1004 may be coupled to main processor 1002 to allow telecommunications. It should be noted that modem 1004 can be connected to main processor 1002 through a separate bus, which is slower than system bus 1008, such as an ISA bus to allow slower communication between modem 1004 and main processor 1002.

Continuing to refer to FIG. 3, a video processing and display unit 1020 is coupled to system bus 1008 through a host interface block 1010. Host interface block 1010 is capable of isolating video processing and display unit 1020 from system bus 1008. Video processing and display unit 1020 includes a video bus 1009 for communicating information between various components of video processing and display unit 1020. A video processor 1022 is coupled to video bus 1009 for compressing and decompressing pixel data, setting up the parameters in direct memory access (DMA) 1030, and the parameters of display monitor 1036 including the refresh rate.

A local video memory 1026 receives pixel data through a memory interface 1024 from either (a) a frame grabber 1028 which obtains images from a camera, (b) storage device 1017, or (c) modem 1004. Because the present invention requires significantly less memory and less total memory bandwidth than a conventional video system, and because a scaled image is displayed directly onto display monitor 1036 without being copied into a local video memory, a less expensive memory such as DRAM rather than VRAM can be used for local video memory 1026.

A raster control unit 1040 is used to determine timing of the scan lines that are to be generated, display characteristics such as interlaced or non-interlaced scanning, and the location of the display monitor raster, etc. Raster control unit 1040 typically includes vertical and horizontal raster counters, a video support component having registers, and vertical and horizontal total comparators, a Window Left/Right comparator, and a Window Top/Bottom comparator (not shown). The vertical and horizontal total comparators generate a repeating sequence of counts that associate the position of the display monitor raster with the vertical and horizontal raster counter values. Raster control unit 1040 may either generate sync signals or gen-lock to external sync signals using conventional means.

The position and size of a display window is determined by programming the registers in the video support component and comparing the values in the registers with the current horizontal and vertical raster counter values.

The Window Left and Right values determine the positions of the left and right edges of a display window within the overall raster. The Window Left/Right comparator outputs a true signal when the horizontal raster counter value is between the Window Left and Window Right values.

The Window Top and Bottom values determine the positions of the top and bottom edges of a display window within the overall raster. The Window Top/Bottom comparator outputs a true signal when the vertical raster counter value is between the Window Top and Window Bottom values.

Video processing and display unit 1020 further includes a display scaler 1032 which obtains data from local video memory 1026 and scales it (or resizes it) in real time for display on display monitor 1036. When data is needed in display scaler 1032, raster control unit 1040 instructs DMA 1030 to transfer bitmap data from local video memory 1026 to display scaler 1032.

Figure 1:
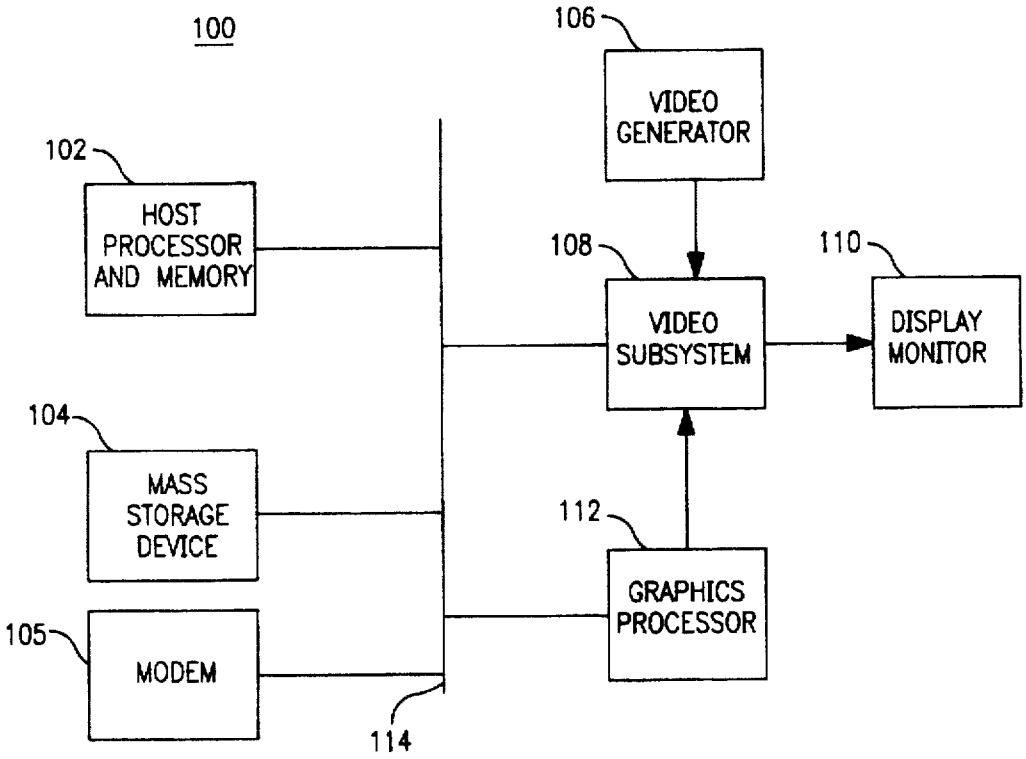
FIG. 1 PRIOR ART
FIG. 1 is a block diagram of a conventional video system.
Figure 2:
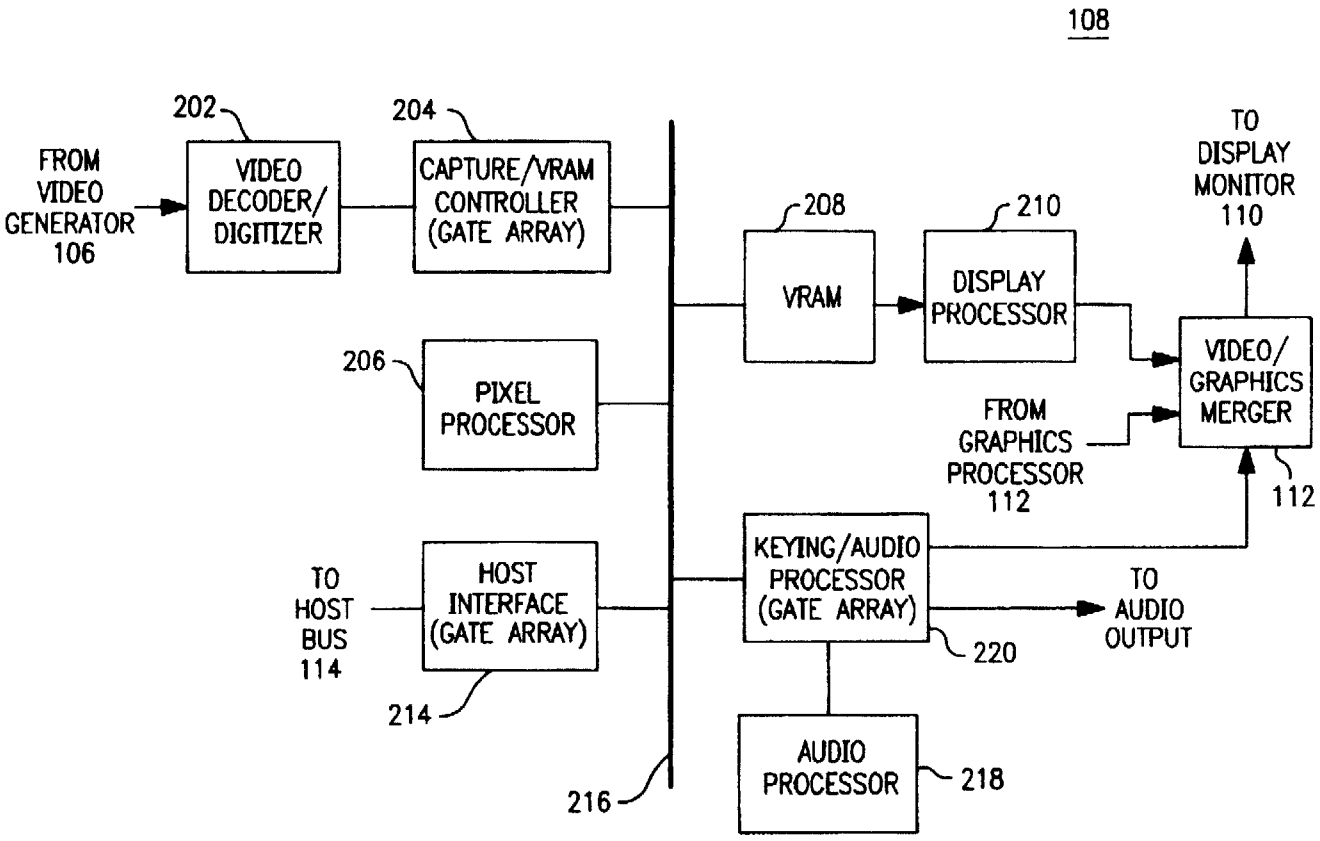
FIG. 2 (PRIOR ART)
FIG. 2 is a block diagram of a video subsystem of the video system of FIG. 1.

Video processing and display unit 1020 also includes a video merging system 1034 that typically has a color converter that converts a YUV format to a RGB format and a digital-to-analog converter that converts digital signals received from display scaler 1032 into analog signals to display on display monitor 1036. Video merging system 1034 may also merge the video data from display scaler 1032 with images from graphics processor 112 of FIG. 1.

Video system 1000 shown in FIG. 3 supports various modes of operation such as the pass-through and video conferencing modes. In the pass-through mode, frame grabber 1028 captures digitized video images from a camera. Video processor 1022 processes the video images (e.g., decoding and filtering). Display scaler 1032 scales the video images for display onto a display window of any size on display monitor 1036 in real time.

In the video conferencing mode, video images are captured and compressed using a video processing and display unit similar to video processing and display unit 1020 at one end of the communication. Through a telecommunication network, the compressed images are sent to modem 1004, and stored into local video memory 1026. After video processor 1022 decompresses the video image data in memory 1026, display scaler 1032 can scale the images in real time for display on display monitor 1036.

Figure 4:
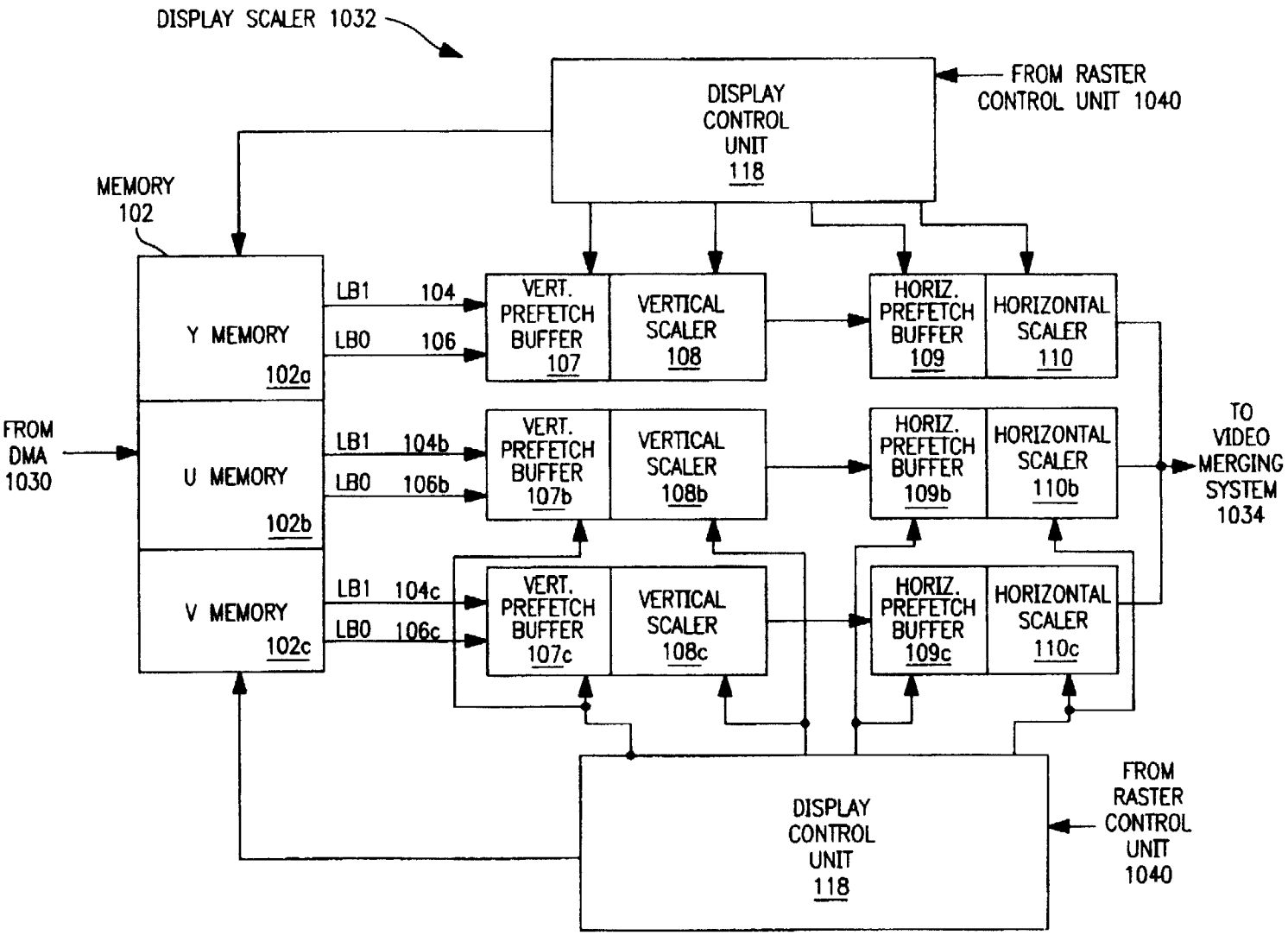
FIG. 4 is a block diagram of the display scaler of the video system of FIG. 3.

FIG. 4 is a block diagram of display scaler 1032 of video system 1000 of FIG. 3. Display scaler 1032 is typically used to scale bitmap data stored in local video memory 1026 of FIG. 3. Display scaler 1032 preferably processes only the bitmap data that is to be actively displayed on display monitor 1036. The bitmap data may be captured video bitmap data or decompressed bitmap data generated after video image compression. The bitmap data may be in full-resolution or in a subsampled format, and it is preferably stored as three separate Y, U, and V component bitmaps.

A memory 102 receives bitmap data from DMA 1030, and stores the Y, U, and V component bitmaps into Y memory 102*a*, U memory 102*b*, and V memory 102*c*, respectively. Memory 102 is considerably smaller in size compared to local video memory 1026. Memory 102 typically contains two scan lines of data for each component of the bitmaps.

While each of the Y, U, and V components includes a separate vertical prefetch buffer, vertical scaler, horizontal prefetch buffer and horizontal scaler, there are typically only two display control units provided for the three components of the bitmaps since the U and V component bitmap data can be controlled simultaneously. However, three separate display control units can be employed, if desired. While display control unit 118 controls Y memory 102*a*, vertical prefetch buffer 107, vertical scaler 108, horizontal prefetch buffer 109, and horizontal scaler 110, display control unit 118*a* controls U memory 102*b*, vertical prefetch buffer 107*b*, vertical scaler 108*b*, horizontal prefetch buffer 109*b*, horizontal scaler 110*b*, V memory 102*c*, vertical prefetch buffer 107*c*, vertical scaler 108*c*, horizontal prefetch buffer 109*c*, and horizontal scaler 110*c* that process the U and V components of the bitmaps.

While Y memory 102*a* stores all the Y component data transmitted from DMA 1030, U memory 102*b* and V memory 102*c* contain subsamples of the U and V components, respectively, transmitted from DMA 1030. The U and V components are typically subsampled at a 4:1 ratio with respect to the Y component. In that instance, while every Y component data is placed into Y memory 102*a*, for the U and V components, only every fourth data point is kept in U memory 102*b* and V memory 102*c*, and the other data points are discarded. This subsample is done because the U and V components describe color, and a user's eyes are not typically sensitive enough to distinguish the slight changes in color, and thus, it is not necessary to process all the U and V data points. The Y, U, and V memories each are provided with dual buffer lines (i.e., LB1 104, LB0 106, LB1 104*b*, LB0 106*b*, LB1 104*c*, and LB0 106*c*) for transmitting data from two adjacent bitmap scan lines to their respective vertical prefetch buffers 107, 107*b*, and 107*c*.

Figure 5:
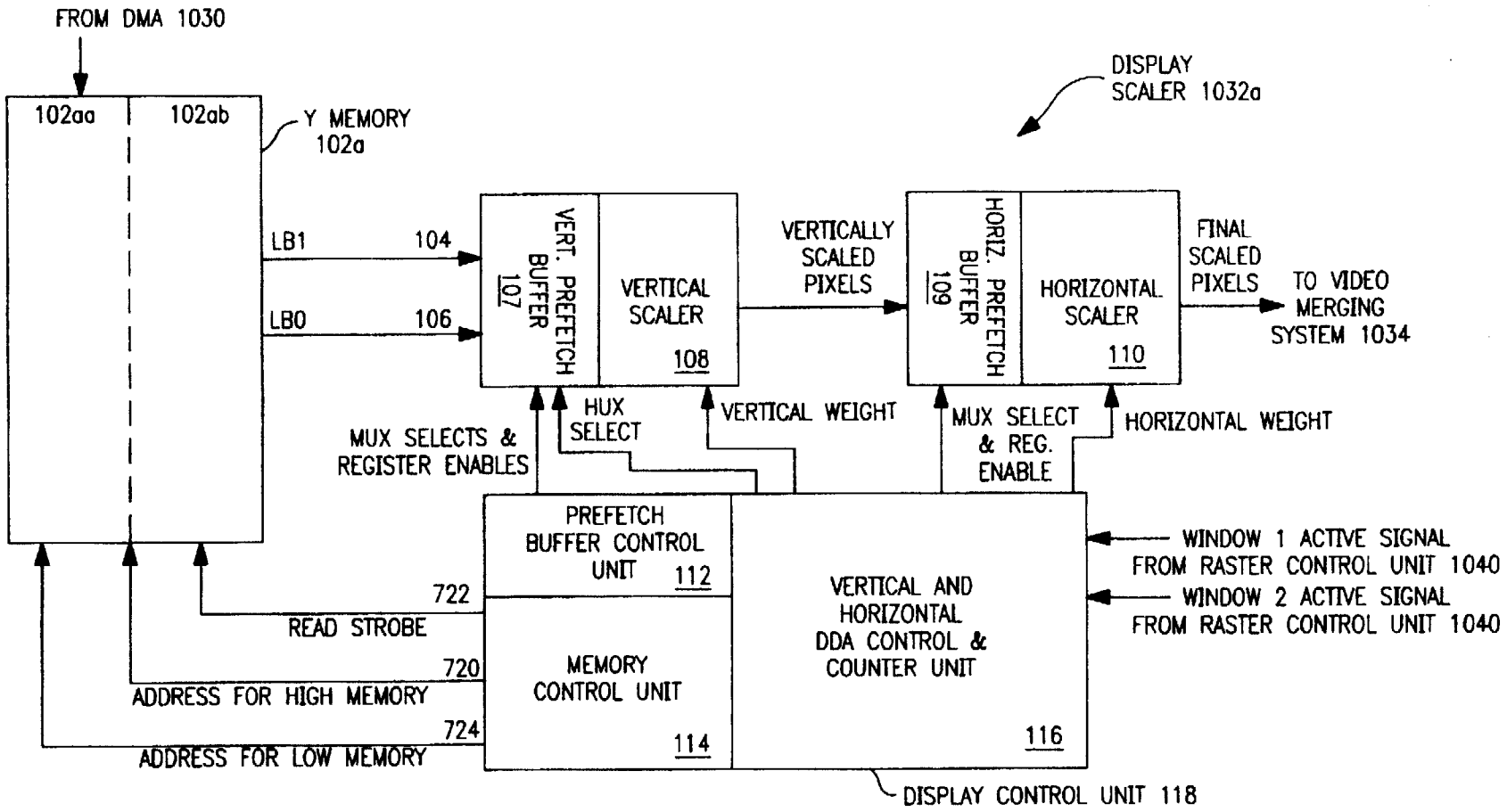
FIG. 5 is a block diagram of a portion of the display scaler of the video system of FIG. 3 showing devices that process a luminance Y component.

Now referring to FIG. 5, a block diagram of a portion of display scaler 1032 processing only the Y component bitmap data is shown. Because the devices that process the U and V components are similar to those that process the Y component, as shown in FIG. 4, the discussion that follows will only concentrate on the Y component. A display scaler 1032*a* in FIG. 5 includes Y memory 102*a*, display control unit 118, vertical prefetch buffer 107, vertical scaler 108, horizontal prefetch buffer 109, and horizontal scaler 110. Display control unit 118 includes a vertical and horizontal digital differential accumulator (DDA) control and counter unit 116, a memory control unit 114, and a prefetch buffer control unit 112.

Vertical and horizontal DDA control & counter unit 116 receives information regarding whether any of the display windows is active/inactive, controls reading of the bitmap data in Y memory 102*a*, and provides the necessary control signals to memory control unit 114, prefetch buffer control unit 112, vertical prefetch buffer 107, vertical scaler 108, horizontal prefetch buffer 109, and horizontal scaler 110.

Memory control unit 114 receives memory addresses from vertical and horizontal DDA control & counter unit 116, and issues a read strobe 722 to Y memory 102*a* when Y memory 102*a* is ready.

Prefetch buffer control unit 112 receives various input signals from memory control unit 114 and vertical and horizontal DDA control & counter unit 116 and issues output signals to control vertical prefetch buffer 107.

Y memory 102*a* can be used for a single display window or a plurality of display windows. For a single display window, the entire memory 102*a* is dedicated for that single display window. If there are two display windows, Y memory 102*a* is typically divided in half or split in the middle (e.g., Y memory 102*aa* and Y memory 102*ab*) to contain data for both display windows. As the number of display windows increases, Y memory 102*a* will be divided further. Y memory 102*a* provides, as outputs, multiple pixel data through each buffer line LB1 104 and LB0 106 to support a display pixel clock frequency that is faster than the Y memory access frequency.

With respect to vertical scaler 108 and horizontal scaler 110, scaling can be continuously variable and independently programmable in both vertical and horizontal dimensions for each display window. Vertical scaler 108 and horizontal scaler 110 receive weights from vertical and horizontal DDA control & counter unit 116 and produce a smoothly filtered enlarged image.

Video system 1000 can support any number of display windows. However, in the following discussions, it is assumed that there are two display windows—a display window 1 (W1) and a display window 2 (W2). W1 is typically placed on top of W2 when the two windows overlap so that W2 is considered "active" only if vertical and horizontal DDA control & counter unit 116 receives a W1 inactive signal and a W2 active signal, while W1 is considered "active" so long as a W1 active signal is received regardless of whether a W2 active or inactive signal is received. It should be noted that although throughout the description of the present invention, it is assumed, for the sake of discussion, that W1 is on top of W2, W2 can be placed on top of W1, if so desired.

Video system 1000 can also utilize components having different operating frequencies. In a typical situation, memory is the slowest component. In FIG. 5, although the various components can operate at different frequencies, it is assumed, for the sake of discussion, in the following description that while Y memory 102*a* operates at 50 MHz, the rest of the devices (i.e., vertical and horizontal DDA control & counter unit 116, memory control unit 114, prefetch buffer control unit 112, vertical prefetch buffer 107, vertical scaler 108, horizontal prefetch buffer 109, and horizontal scaler 110) operate at 80 MHz.

Each of the devices shown in FIG. 5 is described in further detail in FIGS. 6*a*–11.

Figure 6A:
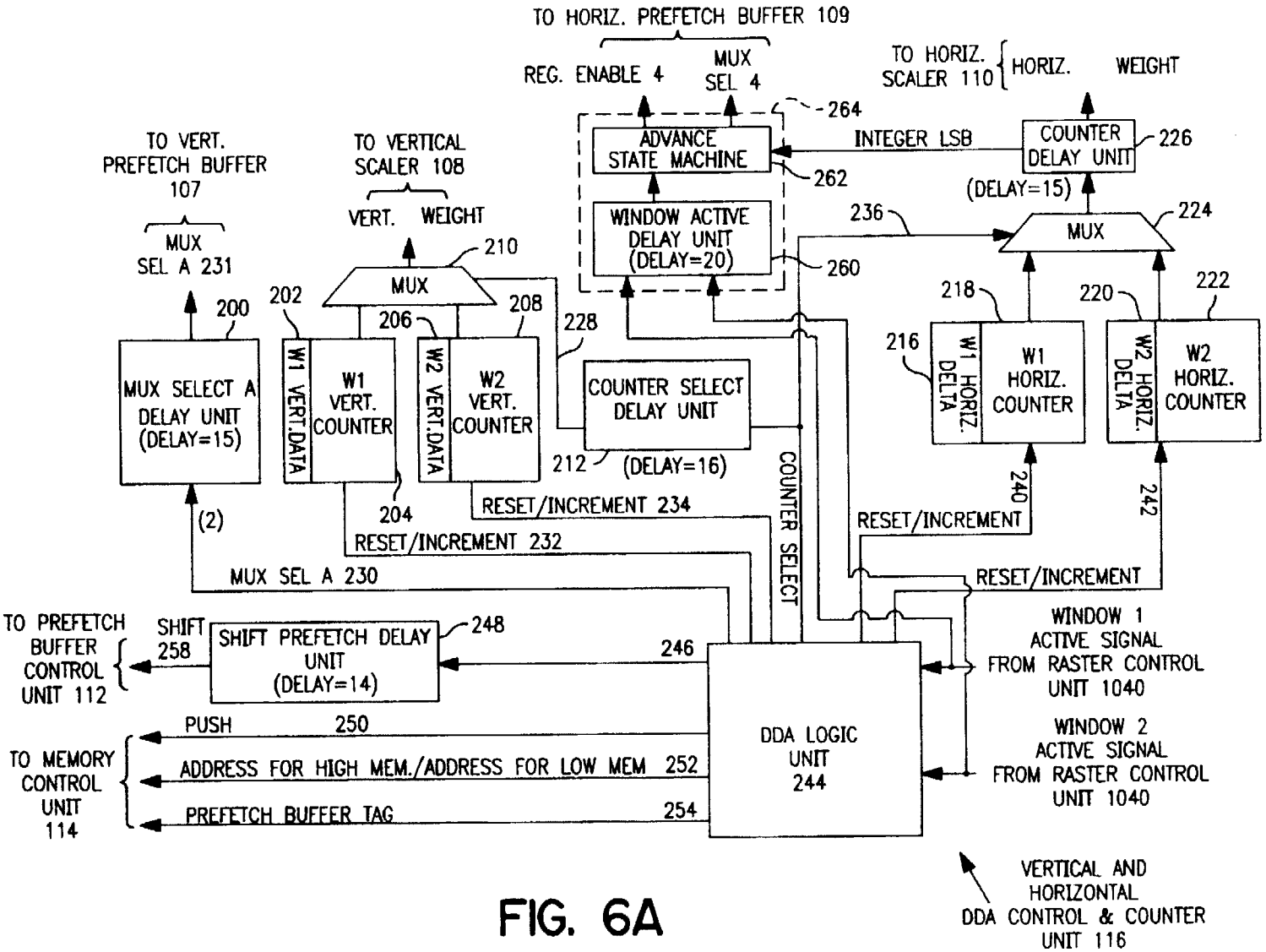
FIG. 6*a* is a block diagram of the vertical and horizontal DDA control & counter unit of FIG. 5.

FIG. 6*a* is a block diagram of vertical and horizontal DDA control & counter unit 116 of FIG. 5 according to one embodiment of the present invention. It should be noted that one ordinarily skilled in the art will understand that there may be alternative embodiments of the vertical and horizontal DDA control & counter unit. Referring to FIG. 6*a*, vertical and horizontal DDA control & counter unit 116 includes a DDA logic unit 244 and various other components to produce the necessary control signals for memory control unit 114, prefetch buffer control unit 112, vertical prefetch buffer 107, vertical scaler 108, horizontal prefetch buffer 109, and horizontal scaler 110. In this embodiment, vertical and horizontal DDA control & counter unit 116 operates at 80 MHz. DDA logic unit 244 receives two signals from raster control unit 1040—a window 1 (W1) active/inactive signal and a window 2 (W2) active/inactive signal. There are many different ways to implement DDA logic unit 244, and one ordinarily skilled in the art will understand how to implement it to provide the various signals described below.

For memory control unit 114, DDA logic unit 244 generates signals such as a push signal 250, addresses 252 for high memory and low memory of Y memory 102*a*, and a prefetch buffer tag 254. Push signal 250 is enabled only when the addresses 252 and prefetch buffer tag 254 are ready to be sent to memory control unit 114. Prefetch buffer tag 254 typically contains encoded LOAD and PF2DIRECT signals that are used by prefetch buffer control unit 112. LOAD 324 and PF2DIRECT 322 signals and the high and low memory of Y memory 102*a* will be described in detail later.

Figures 2, 6B:
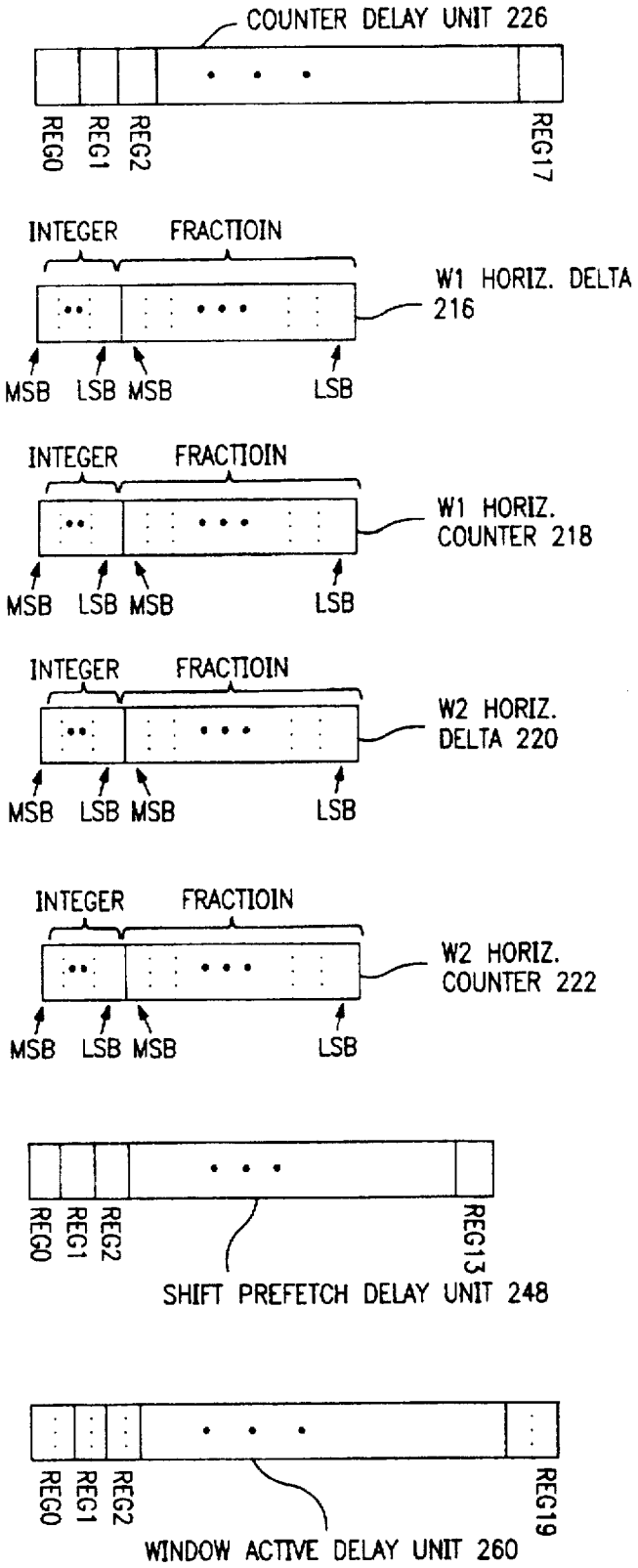
FIG. 6*b* presents the various register units shown in FIG. 6*a;*

For prefetch buffer control unit 112, DDA logic unit 244 generates SHIFT signals 246 to be stored into a shift prefetch delay unit 248 before each of them, as a shift signal 258, is transmitted to prefetch buffer control unit 112. SHIFT signal 258 will be described in detail later. Shift prefetch delay unit 248 is typically a set of registers. One example is shown in FIG. 6*b*. In this embodiment, each SHIFT 258 signal includes one bit, and shift prefetch delay unit 248 includes fourteen registers each having one bit so that the SHIFT signals can be delayed by fourteen clock cycles. This delay is the time difference between when push signal 250 is enabled and when a SHIFT signal is sent to prefetch buffer control unit 112. This delay is necessary to accommodate the frequency differences between Y memory 102*a* and the other components in display scaler 1032*a* (e.g., Y memory 102*a* having an access frequency of 50 MHz and the rest of the devices in FIG. 5 operating at 80 MHz) and other timing sequence concerns.

In another embodiment, shift prefetch delay unit 248 may include more or less registers and bits. In yet another embodiment, shift prefetch delay unit 248 may be omitted if the components in display scaler 1032*a* operate at the same frequency.

Continuing to refer to FIG. 6*a*, DDA logic unit 244 also produces MUX SEL A signals 230, each of which is provided to vertical prefetch buffer 107 as a MUX SEL A 231. MUX SEL A 231 will be described in detail later. A mux select A delay unit 200 is included to delay MUX SEL A signals 230 from reaching vertical prefetch buffer 107. According to one embodiment, mux select A delay unit includes fifteen registers each having two bits so that MUX SEL A signals 230 can be delayed by fifteen clock cycles to accommodate the frequency differences and other timing sequence concerns. The delay is the time difference between when push signal 250 is enabled and when MUX SEL A 231 is provided to vertical prefetch buffer 107.

In another embodiment, mux select A delay unit 200 may include more or less registers and bits. In yet another embodiment, mux select A delay unit 200 may be omitted if the components in display scaler 1032*a* operate at the same frequency.

To provide vertical weights to vertical scaler 108, vertical and horizontal DDA control & counter unit 116 includes a window 1 (W1) vertical delta register 202, a W1 vertical counter 204, a window 2 (W2) vertical delta register 206, a W2 vertical counter 208, a mux 210, and a counter select delay unit 212 according to one embodiment of the present invention. Examples of W1 vertical delta register 202, W1 vertical counter 204, W2 vertical delta register 206, W2 vertical counter 208, and counter select delay unit 212 are shown in FIG. 6*b*. Each of devices 202, 204, 206 and 208 includes an integer portion and a fractional portion each having a most-significant-bit (MSB) and a least-significant-bit (LSB). The integer portions of W1 vertical counter 204 and W2 vertical counter 208 indicate whether a new bitmap data is being processed by vertical scaler 108, and the fractional portions provide the necessary weights to vertical scaler 108.

Counter select delay unit 212 includes, in this embodiment, sixteen registers to delay the counter select signal by sixteen clock cycles. The counter select signal is supplied to mux 210 so that mux 210 can select either the value from W1 vertical counter 204 if W1 is active or the value from W2 vertical counter 208 if W2 is active. The selected counter value is provided to vertical scaler 108 as a vertical weight. Because of the sixteen clock cycle delay, a vertical weight is provided to vertical scaler 108 sixteen clock cycles after a It should be noted that in another embodiment, there may be only one vertical delta register and one vertical counter, and mux 210 may be omitted if there is only one display window. In another embodiment, vertical and horizontal DDA control & counter unit 116 may include more registers for counter select delay unit 212 and/or more counters. As the number of display windows increases, the number of counters also increases. In yet another embodiment, counter select delay unit 212 may be omitted.

To provide horizontal weights to horizontal scaler 110, vertical and horizontal DDA control & counter unit 116 includes a W1 horizontal delta register 216, a W1 horizontal counter 218, a W2 horizontal delta register 220, a W2 horizontal counter 222, a mux 224, and a counter delay unit 226 according to one embodiment of the present invention. Examples of W1 horizontal delta register 216, W1 horizontal counter 218, W2 horizontal delta register 220, W2 horizontal counter 222, and counter delay unit 226 are shown in FIG. 6*b*. Each of devices 216, 218, 220 and 222 includes an integer portion and a fractional portion each having a most-significant-bit (MSB) and a least-significant-bit (LSB). The integer portions of W1 horizontal counter 218 and W2 horizontal counter 222 indicate whether a new data is needed from vertical scaler 108, and the fractional portions provide the necessary weights to horizontal scaler 110.

Counter delay unit 226 includes, in this embodiment, eighteen registers to delay the counter value (either from W1 horizontal counter 218 or from W2 horizontal counter 222) from reaching horizontal scaler 110 by eighteen clock cycles. Because of the eighteen clock cycle delay, a horizontal weight is provided to horizontal scaler 108 eighteen clock cycles after a push signal 250 is enabled. In this embodiment, the counter select signal 236 is not delayed.

It should be noted that in another embodiment, there may be only one horizontal delta register and one horizontal counter, and mux 224 may be omitted if there is only one display window. In another embodiment, there may be a larger or smaller number of registers in counter delay unit 226 and more counters if there are more display windows. In yet another embodiment, counter delay unit 226 may be omitted.

Continuing to refer to FIG. 6*a*, vertical and horizontal DDA control & counter unit 116 also includes an advance block 264 which is used to generate the control signals to be supplied to horizontal prefetch buffer 109. It should be noted that in another embodiment, advance block 264 may reside in DDA logic unit 244 or in horizontal prefetch buffer 109. Advance block 264 includes a window active delay unit 260 and an advance state machine 262. Window active delay unit 260 is used to delay W1 and W2 active/inactive signals received from raster control unit 1040. In one embodiment, window active delay unit 260 includes twenty registers each having two bits to delay the W1 and W2 active/inactive signals from reaching advance state machine 262 by twenty clock cycles. An example of window active delay unit 260 is shown in FIG. 6*b*. Advance state machine 262 receives W1 and W2 active/inactive signals from window active delay unit 260 and generates REG ENBL4 and MUX SEL 4 signals to be provided to horizontal prefetch buffer 109. Advance state machine 262 will be described in more detail with reference to FIGS. 15*a*–17*b*.

Figure 7:
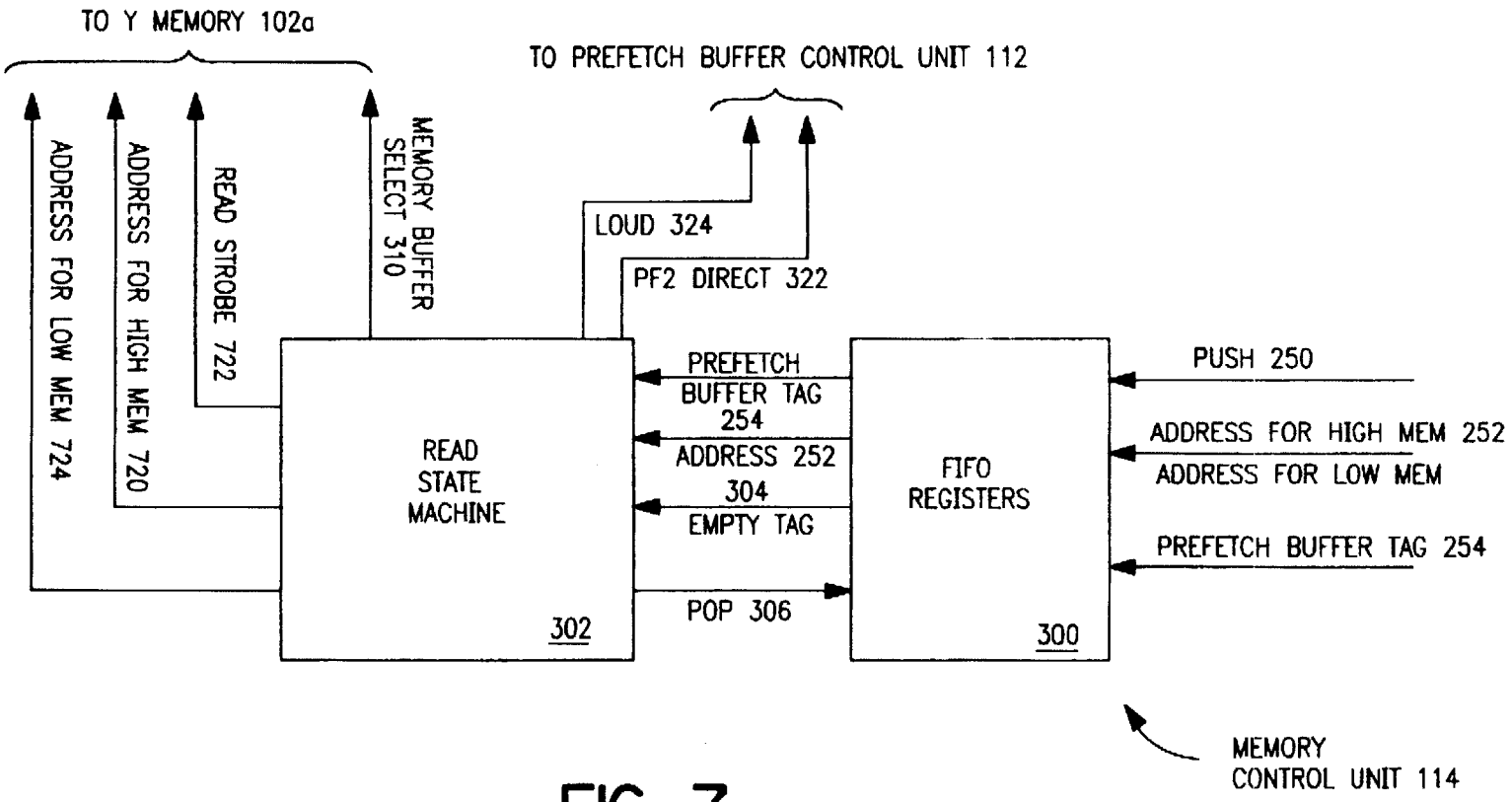
FIG. 7 is a block diagram of the memory control unit of FIG. 5.

FIG. 7 is a block diagram of memory control unit 114 in FIG. 5. Memory control unit 114 includes first-in-first-out (FIFO) registers 300 and a read state machine 302. FIFO registers 300 receive input signals such as push 250, addresses for the high memory and low memory 252, and prefetch buffer tag 254 from vertical and horizontal DDA control & counter unit 116. FIFO registers 300 include a plurality of registers each having enough storage locations to store the addresses for the high and low memories and the prefetch buffer tag. According to one embodiment, FIFO registers 300 include two registers. When push signal 250 is enabled, addresses for the high and low memory 252 and prefetch buffer tag 254 are stored into FIFO registers 300. When a pop signal 306 is enabled, the prefetch buffer tag and the addresses are transmitted from FIFO registers 300 to read state machine. When FIFO registers 300 are empty, an empty flag 304 will be enabled.

Read state machine 302 provides the addresses for the high and low memories and read strobe signal 772, and a memory buffer select 310 to Y memory 102*a*. Read state machine 302 also provides LOAD 324 and PF2DIRECT 322 signals to prefetch buffer control unit 112. The functionality of read state machine 302 will be discussed later with respect to FIG. 12.

Figure 8:
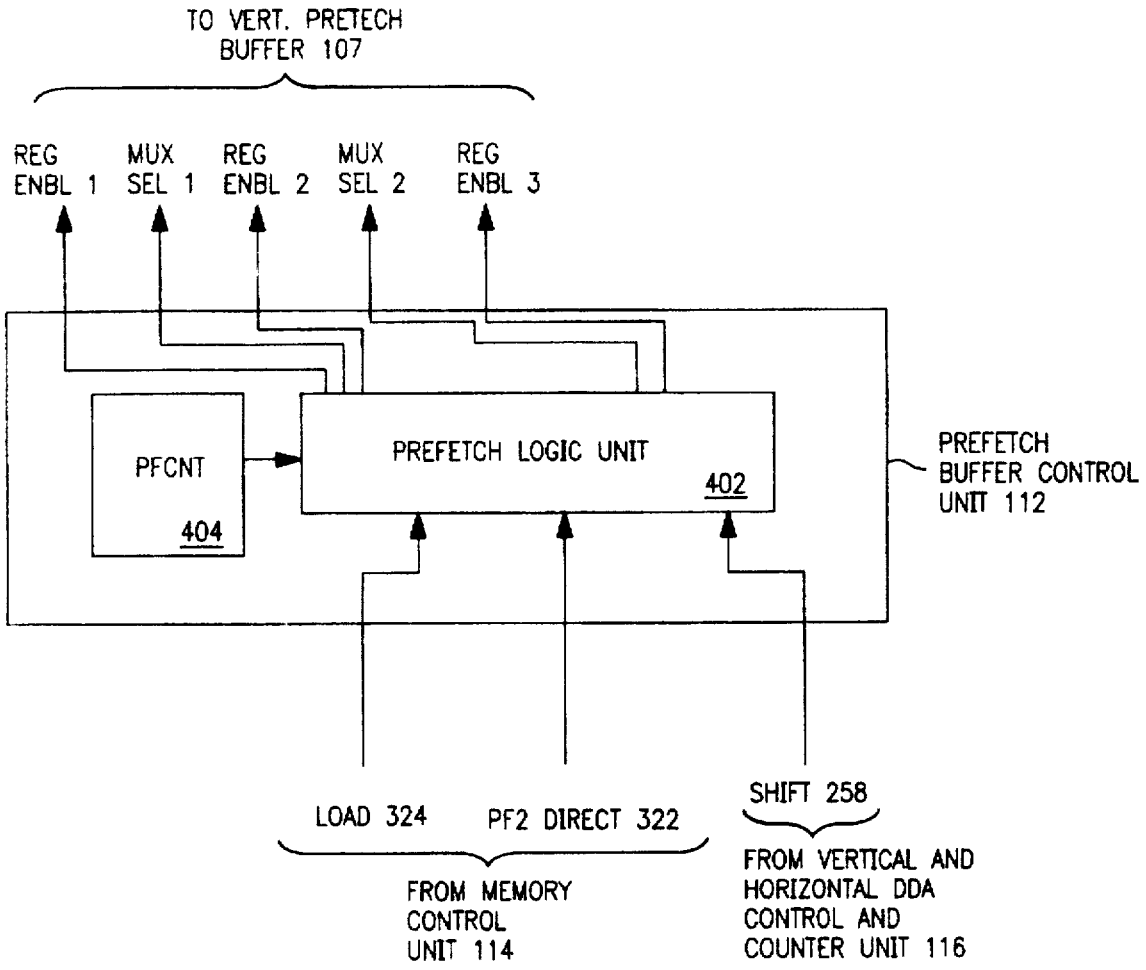
FIG. 8 is a block diagram of the prefetch buffer control unit of FIG. 5.

FIG. 8 is a block diagram of prefetch buffer control unit 112 in FIG. 5. Prefetch buffer control unit 112 receives input signals from vertical and horizontal DDA control & counter unit 116 and memory control unit 114 and generates control signals to be provided to vertical prefetch buffer 107. Prefetch buffer control unit 112 includes a prefetch counter (PFCNT) unit 404 and a prefetch logic unit 402. Prefetch logic unit 402 receives LOAD and PF2DIRECT signals from memory control unit 114 and shift signals from vertical and horizontal DDA control & counter unit 116, and counter values that are incremented by PFCNT 404. Prefetch logic unit 402 provides as outputs REG ENBL 1, MUX SEL 1, REG ENBL 2, MUX SEL 2, and REG ENBL 3 signals to vertical prefetch buffer 107. The details regarding prefetch logic unit 402 will be discussed further with respect to FIG. 14.

Figure 9:
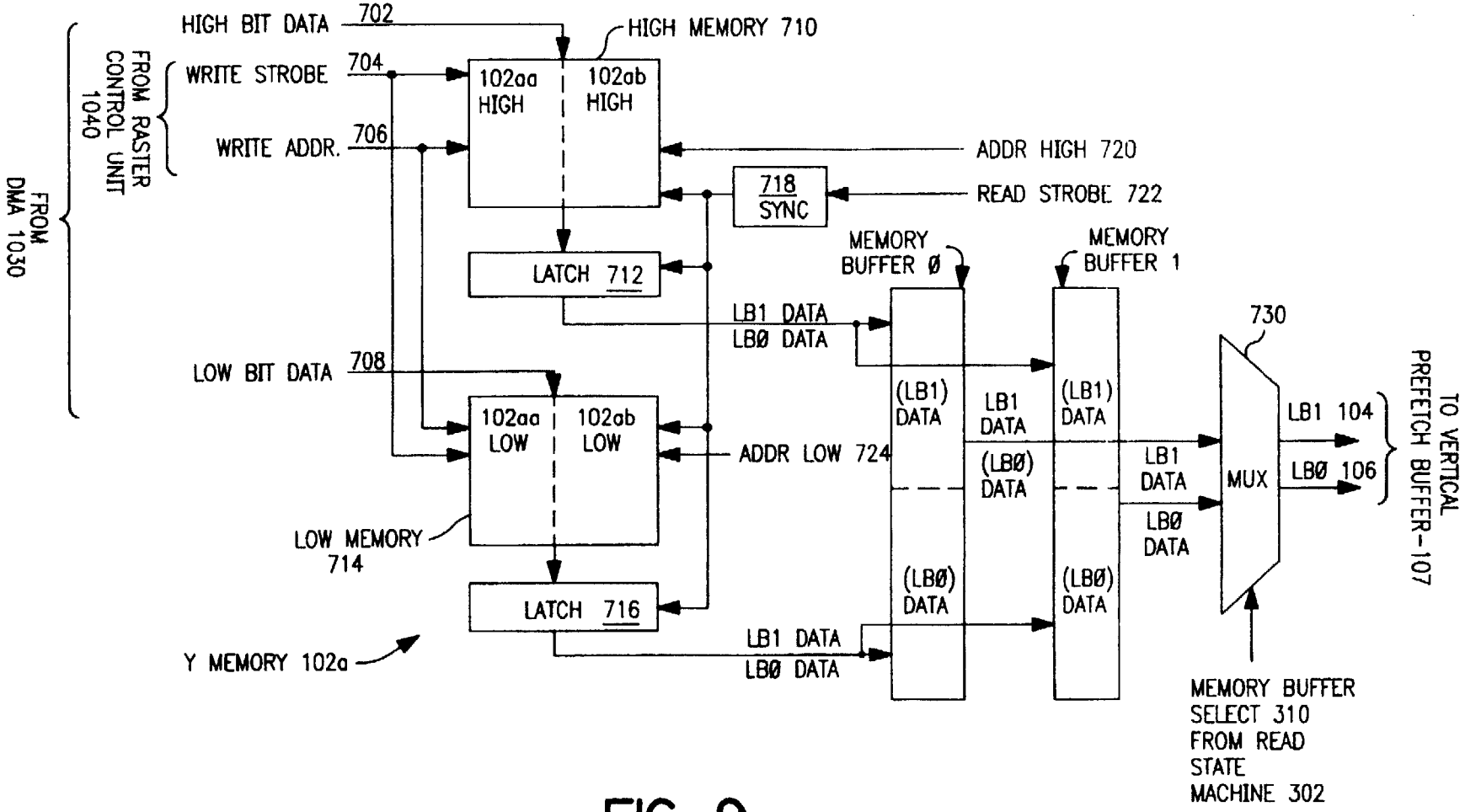
FIG. 9 is a block diagram of a memory of the video system of FIG. 5.

FIG. 9 is a block diagram of Y memory 102*a* in FIG. 5. Y memory 102*a* includes a high memory 710, a low memory 714, latches 712 and 716, a synchronization unit 718, memory buffers 0 and 1, and a mux 730. When there are two display windows (W1 and W2), high memory 710 and low memory 714 each are divided into two halves—102*aa* high, 102*ab* high, 102*aa* low, and 102*ab* low. To write data into high memory 710 and low memory 714, raster control unit 1040 enables the write strobe signal 704 and indicates the write address along the write address line 706. The high memory data is supplied from DMA 1030 to high memory 710 through a high bit data line 702, and low memory data is supplied from DMA 1030 to low memory 714 through a low bit data line 708.

To read the bit map data in high memory 710 and low memory 714, read state machine 302 in FIG. 7 enables read strobe signal 722, and provides the high and low addresses 720 and 724 to high memory 710 and low memory 714, respectively. After read strobe signal 722 is synchronized with Y memory 102*a* using synchronization unit 714, the bit map data in high memory 710 and low memory 714 are latched into latch units 712 and 716. Both the LB1 and LB0 data corresponding to two different scan lines are latched into latch units 712 and 716. Depending upon which memory buffer was last used, LB1 and LB0 data are transmitted to the memory buffer that was not used during the last read operation. For instance, if the last LB1 and LB0 data were stored into memory buffer 0, then the next LB1 and LB0 data will be stored into memory buffer 1. On the other hand, if the last LB1 and LB0 data were stored into memory buffer 1, then the next LB1 and LB0 data will be stored into memory buffer 0.

Read state machine 302 supplies memory buffer select signal 310 to mux 730 so that mux 730 can select the LB1 and LB0 data from either memory buffer 0 or memory buffer 1. Memory buffer select signal 310 toggles such that if mux 730 selected memory buffer 0 during the last read operation, then mux 730 will select memory buffer 1 for the next read operation. Mux 730 outputs LB1 and LB0 data as output to vertical prefetch buffer 107 in FIG. 5.

Figure 10:
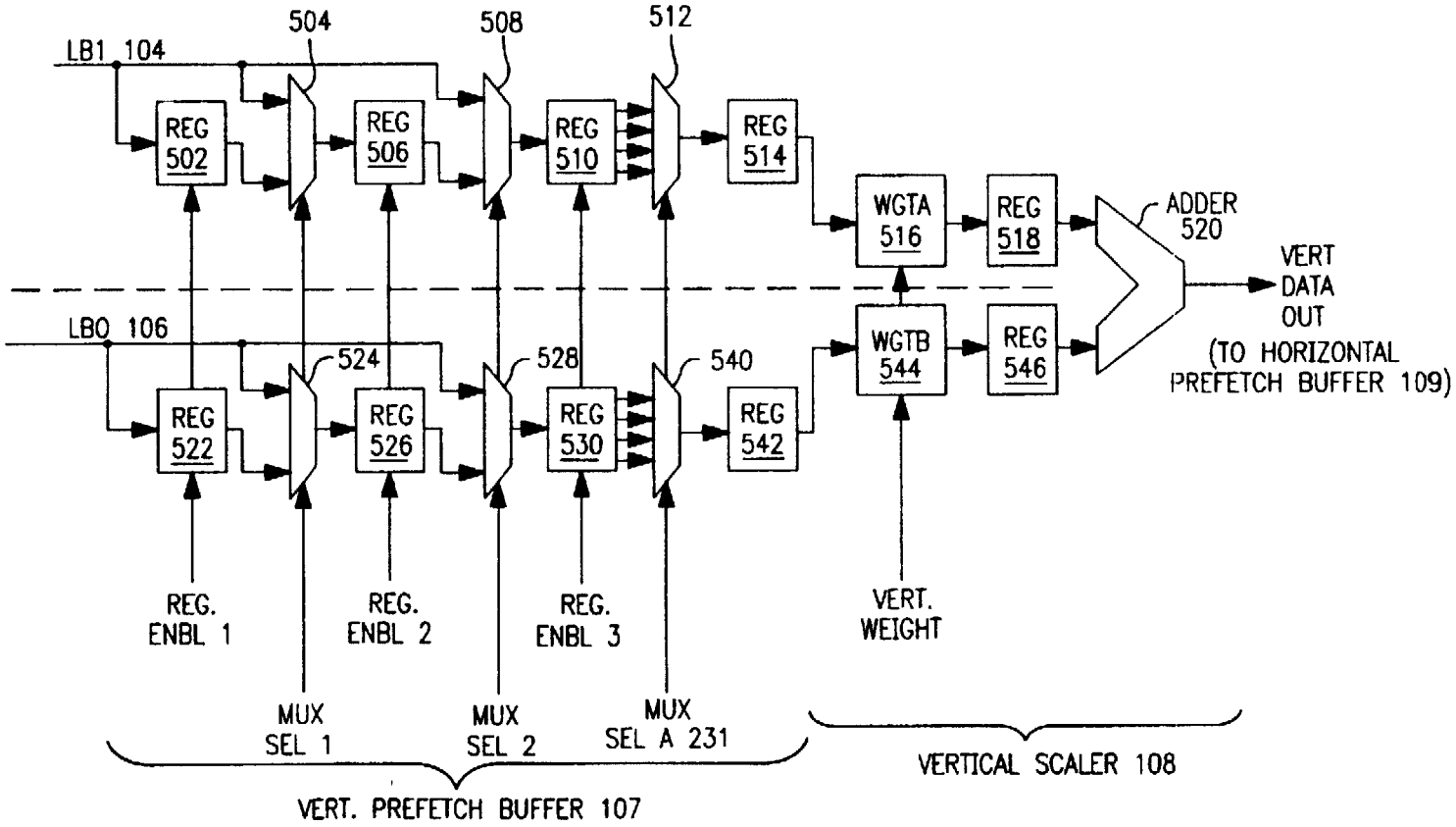
FIG. 10 is a block diagram of the vertical prefetch buffer and vertical scaler of FIG. 5.

FIG. 10 is a block diagram of vertical prefetch buffer 107 and vertical scaler 108 in FIG. 5. To support overlapping of multiple windows with no artifacts due to the ensuing occlusion, to discard any unused bitmap data at window overlap boundaries, to support display pixel clock frequency that is higher than the access frequency of Y memory 102*a*, and to display any number of bytes on to a display window, vertical prefetch buffer 107 employs multiple registers (e.g., registers 502, 506 and 510 for data coming from LB1, and registers 522, 526 and 530 for data coming from LB0) and mux's (504, 508 and 512 for data coming from LB1, and mux's 524, 528 and 540 for data coming from LB0).

Each of the registers 502, 506, 510, 522, 526 and 530 receives a plurality of bitmap data. While a bitmap data is typically represented by 8 bits, each of the registers 502, 506, 510, 522, 526 and 530 includes 32 bits to receive 4 bytes of bitmap data at a time according to one embodiment where Y memory 102*a* operates at 50 MHz, and the other components of display scaler 1032*a* operates at 80 MHz. Having multiple bytes of data in a register enables display scaler 1032*a* to support the differences between the display pixel clock frequency and the memory access frequency. The amount of bitmap data needed to be stored in a register depends on the amount of difference between the clock frequencies. In another embodiment, there may be more bytes or less bytes stored per register. In this embodiment, there are three registers (502, 506 and 510; and 522, 526 and 530) for each LB1 and LB0 data. However, as the number of display windows increases, vertical prefetch buffer 107 may have more registers.

Bitmap data that is available on LB1 can be stored into register 502, 506 or 510. When register 510 is available, the bitmap data is stored into register 510. However, if register 510 is not available to receive data, register 506 will receive the data from LB1. Also, if both registers 510 and 506 are occupied, then register 502 will receive data from LB1. Similarly, when data is present at LB0, depending on the availability of the registers, LB0 data will be stored into register 530, 526 or 522 in that order.

While registers 502, 506, 510, 522, 526 and 530 each contain 4 bytes of bitmap data, registers 514 and 542 each contain only 1 byte of bitmap data. MUX SEL A 231 controls which of the 4 bytes is to be chosen from registers 510 and 530. To process bitmap data that resides in register 506, that data must be shifted to register 510, and then to register 514. Also, the data in register 502 must be first shifted to register 506, then to register 510, and finally to register 514 to be processed by vertical scaler 108. Similarly, the bitmap data that resides in register 526 must be shifted to register 530 and then to 542, and the bitmap data in register 522 must be shifted to register 526, to register 530, and then to register 542 to be processed by vertical scaler 108.

Vertical prefetch buffer 107 is a first-in-first-out (FIFO) buffer because LB1 and LB0 data go into registers 510 and 530, registers 506 and 526, and registers 502 and 522 in that order depending on the availability, and data is outputted from registers 510 and 530, then registers 506 and 526, and then registers 502 and 522 in that order.

Vertical prefetch buffer 107 is a variable length buffer for the following reasons. When data to be displayed is not near a window overlap boundary (e.g., pixels $P^1$0, 0 or $P^1$m, 0 in FIG. 18), data from Y memory 102*a* (i.e., LB1 and LB0 data) is always stored into registers 510 and 530. Thus, in this first instance, vertical prefetch buffer 107 has a storage size that equals the number of bytes in registers 510 and 530. However, when data to be displayed approaches the window overlap boundary (e.g., pixel $P^1$m, 1 in FIG. 18), the data for W1 goes into registers 510 and 530 while the data for W2 goes into registers 506 and 526. Thus, in this second instance, vertical prefetch buffer 107 has a storage size that is equivalent to the size of the registers 506, 510, 526 and 530 combined. In addition, if one of the overlapping windows is very narrow in width (e.g., W1 in FIG. 23), then the data from Y memory 102*a* may occupy all six registers 502, 506, 510, 522, 526 and 530. In this third instance, vertical prefetch buffer 107 has a storage size equivalent to the size of six registers. Therefore, vertical prefetch buffer 107 has an adjustable storage size.

In addition, it should be noted that data from LB1 and LB0 arrives at vertical prefetch buffer 107 simultaneously and in parallel, and the data in the upper half (e.g., 502, 506, 510, and 514) of vertical prefetch buffer 107 and the lower half (e.g., 522, 526, 530, and 542) are processed simultaneously and controlled by the same control signals. The details of operation of vertical prefetch buffer 107 will be discussed more later. Register enable signals, REG ENBL 1, REG ENBL 2, REG ENBL 3, and mux signals, MUX SEL 1 and MUX SEL 2, are provided by prefetch buffer control unit 112, and MUX SEL A 231 is received from vertical and horizontal DDA control & counter unit 116.

Continuing to refer to FIG. 10, vertical scaler 108 includes a weight multiplier Wgt A 516 and a register 518 for bitmap data received from LB1, and a weight multiplier Wgt B 544 and a register 546 for bitmap data received from LB0. Vertical scaler 108 further includes an adder 520 that adds the results from registers 518 and 546. Vertical and horizontal DDA control & counter unit 116 supplies the vertical weights to Wgt A 516 and Wgt B 544.

While one of the weight multipliers has a weight that is the same as the weight supplied by vertical and horizontal DDA control & counter unit 116, the other weight multiplier takes the value of the first weight multiplier subtracted by 1.

For instance, if Wgt A 516 has a weight equal to 0.25, then Wgt B 544's weight value is 0.75 which is (1–0.25). The weight value typically changes from one scan line to the next (e.g., each of the scan lines $A^1$0, $A^1$1, $A^1$2 and $A^1$3 in FIG. 21*b* has a different vertical weight value).

According to one embodiment of the present invention, the weight supplied by vertical and horizontal DDA control and counter 116 includes 3 bits, registers 518 and 546 each include 11 bits, adder 520 includes 11 bits, and the output from vertical scaler 108 contains 8 bits to be sent to horizontal prefetch buffer 109.

Figure 11:
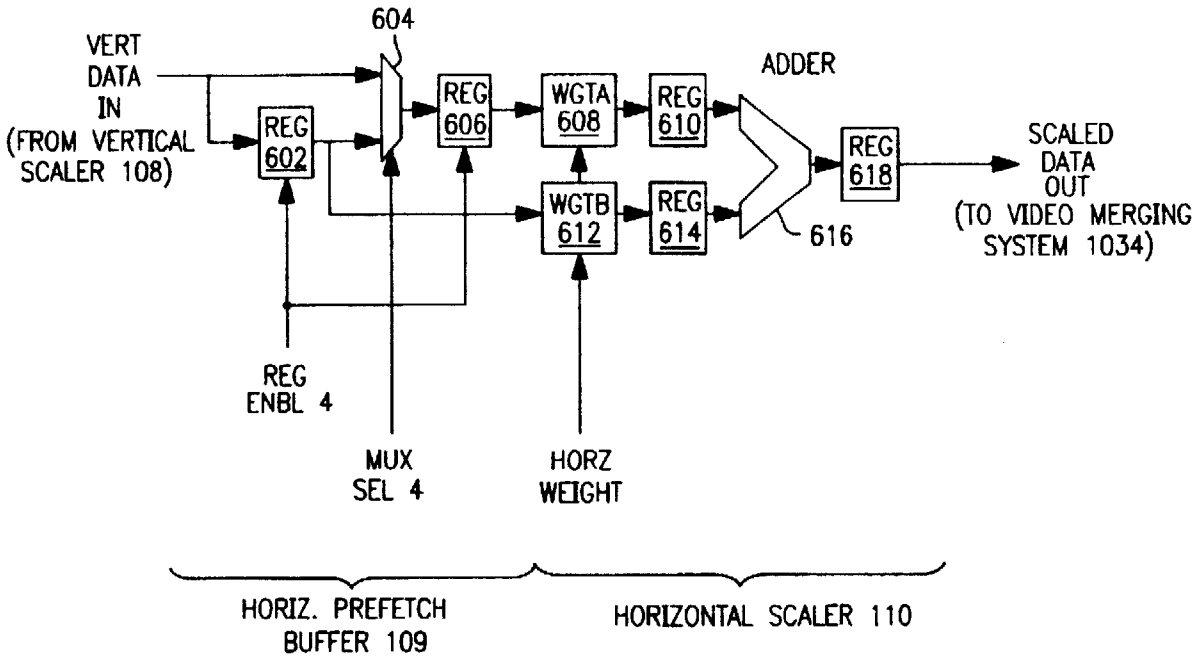
FIG. 11 is a block diagram of the horizontal prefetch buffer and horizontal scaler of FIG. 5.

FIG. 11 is a block diagram of horizontal prefetch buffer 109 and horizontal scaler 110 in FIG. 5. Horizontal prefetch buffer 109 includes registers 602 and 606 and mux 604. The data received from vertical scaler 108 is stored into either register 602 or 606 or both, depending on the value of MUX SEL 4 and REG ENBL 4. For instance, if MUX SEL 4 is 1, and REG ENBL 4 is 1 (active), then the data from vertical scaler 108 is stored into both registers 602 and 606. If, on the other hand, MUX SEL 4 is 0, and REG ENBL 4 is 1, then the old data is shifted from register 602 to register 606, and the new data from vertical scaler 108 is stored into register 602. Although registers 602 and 606 are controlled by the same enable signal in this embodiment, they may have separate enable signals in another embodiment. Also, according to one embodiment of the present invention, registers 602 and 606 contain 8 bits. However, registers 602 and 606 are not limited to this size.

Continuing to refer to FIG. 11, horizontal scaler 110 includes a weight multiplier Wgt A 608 and a register 610 for data received from register 606, and a weight multiplier Wgt B 612 and a register 614 for data received from register 602. Horizontal scaler 110 also includes an adder 616 that adds the data received from registers 610 and 614. Also included in horizontal scaler 110 is a register 618 which contains the final result that can be sent out to video merging system 1034.

According to one embodiment of the present invention, the weight supplied from vertical and horizontal DDA control & counter unit 116 includes 3 bits of data, while registers 610 and 614 and adder 616 each include 11 bits, and register 618 includes 8 bits. The sizes of the weight, registers and adder are not limited to the values described above.

The values of Wgt A 608 and Wgt B 612 are calculated in a manner similar to those of Wgt A 516 and Wgt B 544 in vertical scaler 108. Once a weight value is supplied by vertical and horizontal DDA control & counter unit 116, one of the weight multipliers (608 or 612) takes the value as received, while the other weight multiplier takes the weight value subtracted by 1. The weight value of horizontal scaler 110 varies from one pixel point to another as displayed on a display window (e.g., pixels $P^1$0, 0 and $P^1$0, 1 in FIG. 21*b* have different weight values). In addition, the weight values supplied to horizontal scaler 110 are independent of the weight values supplied to vertical scaler 108.

Figure 12:
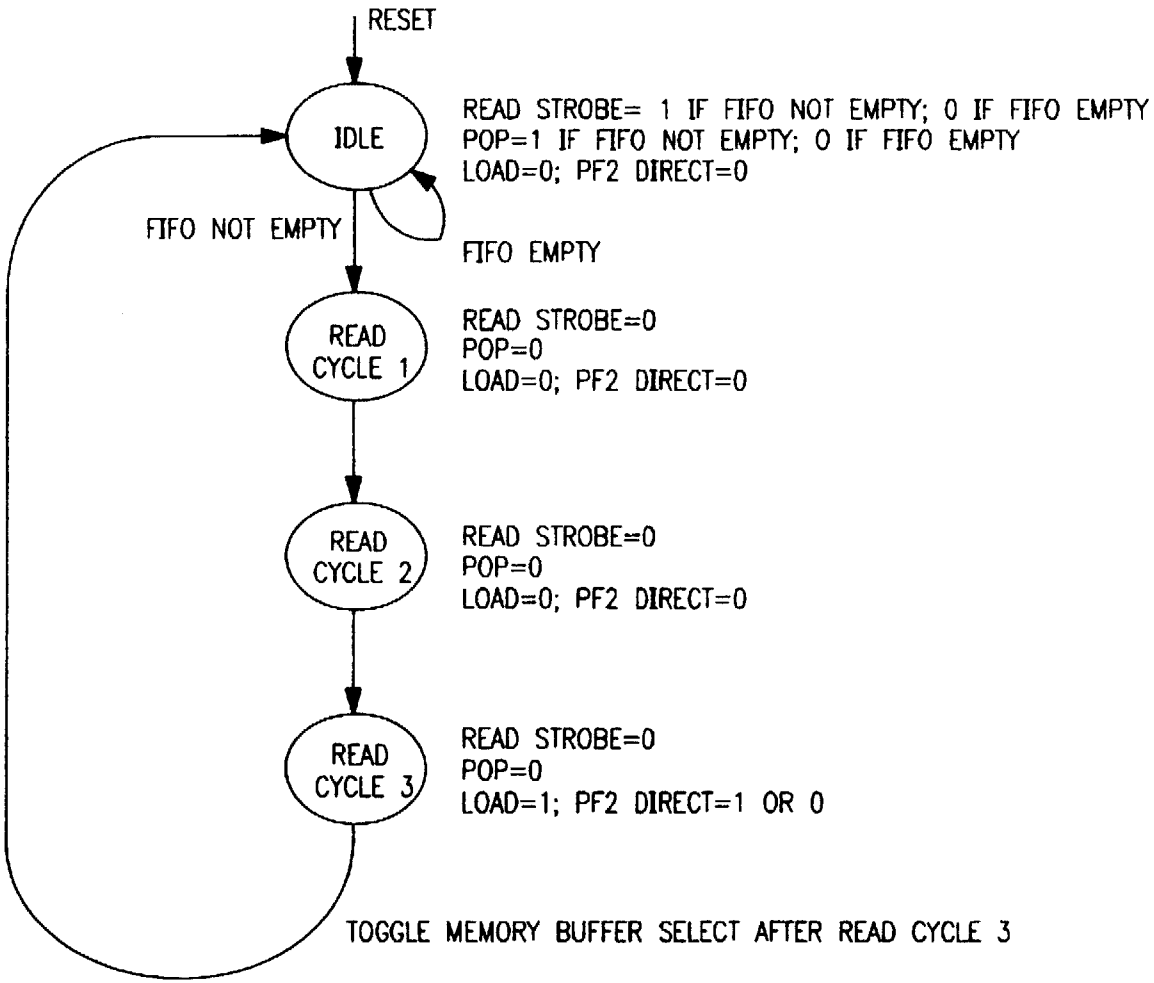
FIG. 12 is a state diagram of the read state machine in FIG. 7.

FIG. 12 is a state diagram of read state machine 302 of FIG. 7. In this example, because Y memory 102*a* operates at 50 MHz, and memory control unit 114 operates at 80 MHz, a read operation typically requires four read cycles as shown in FIG. 12. In an idle state, read strobe 722 will be enabled (1) if FIFO registers 300 are not empty. Read strobe signal 722 will be inactive (0) if FIFO registers 300 are empty. POP 306 will be enabled (1) if FIFO registers 300 are not empty, and disabled (0) if FIFO registers 300 are empty. In the idle state, both LOAD and PF2 DIRECT are disabled. If FIFO registers 300 are empty, then read state machine 302 remains at the idle state.

If FIFO registers 300 are not empty, then during the next two read cycles (read cycle 1 and read cycle 2), read strobe 722, POP 306, LOAD and PF2 DIRECT signals are inactive. During these two cycles, bitmap data from Y memory 102*a* is transferred to either memory buffer 0 or memory buffer 1 in FIG. 9. During the next read cycle (read cycle 3), read strobe 722 and POP 306 are still inactive while LOAD becomes active (1). PF2 DIRECT may be active or inactive depending on whether bitmap data from LB1 and LB0 need to be stored into registers 510 and 530. After the last read cycle (read cycle 3), memory buffer select 310 toggles its value so that mux 730 in FIG. 9 will select memory buffer 1 if memory buffer 0 was chosen previously, or memory buffer 0 if memory buffer 1 was chosen previously. This completes one read operation, and the read cycle 3 is followed by the idle state.

It should be noted that in another embodiment, a read operation may take more number of read cycles or less number of read cycles depending on the differences between the memory access frequency and the operating frequency of memory control unit 114.

Figure 13A:
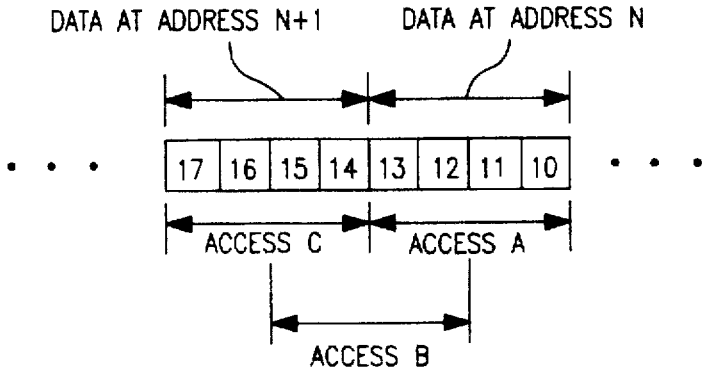
FIG. 13*a* illustrates various data access scenarios of the memory of the video system of FIG. 5.

FIG. 13*a* illustrates various data access scenarios of Y memory 102*a* in FIG. 5. A plurality of bitmap data such as those shown in FIG. 13*a* can be stored into memory portion 102*aa* or 102*ab* in FIG. 5. In one scenario, during a read operation, for each of LB1 104 and LB0 106, 4 bytes of bitmap data are read from either memory portion 102*aa* or 102*ab*. For example, during a read operation, 4 bytes having the first byte at address N (i.e., Access A) are fetched. During the next read operation, if all of the previous 4 bytes (Access A) are used by vertical and horizontal scalers 107 and 110, then the next 4 bytes (Access C) are fetched. If, on the other hand, not all of the previous 4 bytes are used by vertical and horizontal scalers 107 and 110, then some of the bytes that were fetched previously will be refetched. For example, Access B can occur if bytes 12 and 13 were not used. Thus, although 4 bytes of data are fetched at a time for each of LB1 104 and LB0 106, it is possible to access data at a 1 byte, 2 byte, 3 byte, or 4 byte boundary. In FIG. 13*a*, while Access A occurs at a 4 byte boundary, Access B occurs at a 2 byte boundary.

Figure 13B:
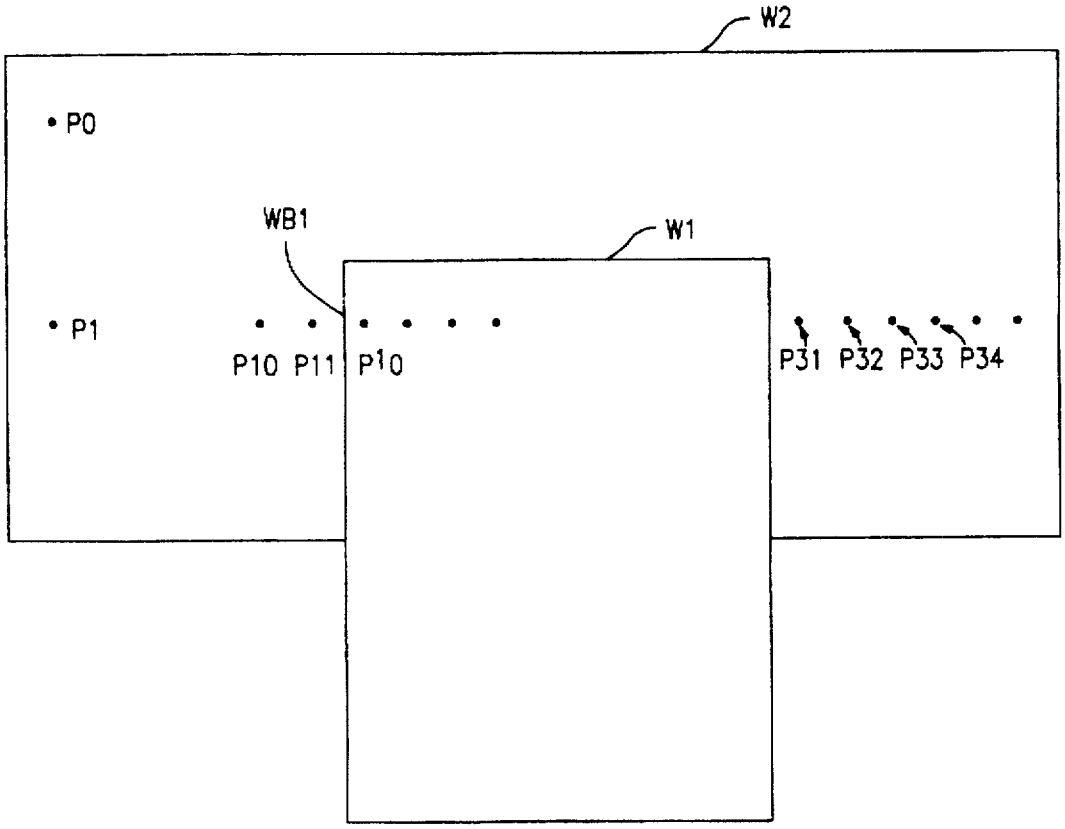
FIG. 13*b* is a set of overlapping windows.

Being able to access data at different byte boundaries are important for windows that overlap. In a case where pixel data to be displayed is not near the window overlap boundary (e.g., P0, P1 in FIG. 13*b*), bitmap data is transferred from Y memory 102*a* to registers 510 and 530 in FIG. 10 at every 4 byte boundary (e.g., Access A and Access C in FIG. 13*a*). However, as one approaches a window overlap boundary (e.g., WB1 in FIG. 13*b*), some of the data for W2 in FIG. 13*b* needs to be discarded to transition from W2 to W1. For example, if bytes 10 and 11 in FIG. 13*a* correspond to P10 and P11 in FIG. 13*b*, then bytes 12 and 13 in FIG. 13*a* will be discarded during the transition. When one moves back to W2, new data is fetched to display P31, P32, P33, and P34 in FIG. 13*b*. Depending on how many bytes have been discarded, the next data access may occur at a 1 byte, 2 byte, 3 byte or 4 byte boundary. In this instance since two bytes (bytes 12 and 13) have been discarded previously, the new data access occurs at a 2 byte boundary.

FIG. 14 illustrates various input and output signals of prefetch logic unit 402 of FIG. 8. Referring to FIGS. 8 and 14, as input signals, prefetch logic unit 402 includes LOAD 324 and PF2DIRECT 322 from memory control unit 114, SHIFT 258 from vertical and horizontal DDA control & counter unit 116, and PFCNT 404. Prefetch logic unit 402 may also receive an initialization signal for initializing prefetch logic unit 402 from vertical and horizontal DDA control and counter unit 116.

LOAD 324 and PF2DIRECT 322, SHIFT 258 and PFCNT 404 signals are used to control the register enable and mux select signals of vertical prefetch buffer 107. LOAD 324 becomes enabled when a new window becomes active or when a new set of bitmap data needs to be read from Y memory 102*a* (e.g., Access A, Access B and Access C in FIG. 13*a*). For example, in FIG. 18, along a scan line $H^1$0, LOAD 324 is enabled at the beginning of the scan line to read the first 4 bytes of data from Y memory 102*a*, during the subsequent read operations, as new sets of data are needed, LOAD 324 becomes enabled. In addition, as one transitions from W1 to W2, W2 becomes active and it triggers LOAD 324 to become enabled.

SHIFT 258 becomes enabled to shift data stored in a vertical prefetch buffer register (e.g., 502, 506, 522, or 526 in FIG. 10) to another register (e.g., 506, 510, 526, or 530 in FIG. 10).

PFCNT 404 indicates the number of registers in vertical prefetch buffer 107 having valid data. For instance, PFCNT is 0 when only registers 510 and 530 include valid data. PFCNT is 1 when registers 506, 526, 510 and 530 have valid data. PFCNT is 2 when all of the registers 502, 506, 510, 522, 526 and 530 include valid data. PFCNT is 3 when there is an error. Thus, PFCNT 404 tracks the fullness of the registers in vertical prefetch buffer 107 and the number of registers having valid data.

PF2DIRECT 322 becomes enabled when LB1 and LB0 data needs to be loaded directly into registers 510 and 530. This occurs when there was no active display window previously, but there is an active display window now.

Depending on the values of the LOAD, SHIFT, PFCNT and PF2DIRECT signals, it is possible to (1) shift old data from the left to the right register(s) (e.g., from 502 to 506, from 506 to 510, or both) and load new data from memory 102*a* into a register, (2) only load data, (3) only shift data, or (4) do nothing.

Referring to FIGS. 8, 10, and 14, MUX SEL 1 and 2 each are used to select one of the two options: (1) loading new data from LB1 and LB0 or (2) shifting data from the left to the right register(s). REG ENBL 1, 2 and 3 are register enable signals that enable registers 502, 522, 506, 526, 510 and 530. For instance, if MUX SEL 2 is 1 and REG ENBL 3 is 1, then the bitmap data from LB1 and LB0 will be directly loaded into registers 510 and 530. If MUX SEL 2 is 0 and REG ENBL 3 is 1, then the data in registers 506 and 526 will be shifted into registers 510 and 530, respectively. If MUX SEL 1 and 2 are 0, and REG ENBL 2 and 3 are 1, then, the data in registers 506 and 526 will be shifted into registers 510 and 530, respectively, and the data in registers 502 and 522 will be shifted into registers 506 and 526, respectively. If MUX SEL 1 is 1, MUX SEL 2 is 0, and REG ENBL 2 and 3 are 1, then the data in registers 506 and 526 will be shifted into registers 510 and 530, respectively, and new data from LB1 and LB0 will be loaded into registers 506 and 526, respectively.

FIG. 14 summarizes the relationships between the input signals LOAD, SHIFT, PFCNT, and PF2DIRECT and the output signals REG ENBL 1, MUX SEL 1, REG ENBL 2, MUX SEL 2, and REG ENBL 3. MUX SEL 2 is enabled (a) if LOAD 324 and PF2DIRECT 322 are enabled, or (b) if LOAD 324 is enabled and PFCNT 404 is equal to 0. REG ENBL 3 is enabled (a) if LOAD 324 and PF2DIRECT 322 are enabled, or (b) if SHIFT 258 is enabled.

For example, when LOAD 324 is 0, SHIFT 258 is 1, and PFCNT 404 is 2 (or 10 in binary), then REG ENBL 1 is a 0, MUX SEL 1 is 0, REG ENBL 2 is 1, MUX SEL 2 is 0, and REG ENBL 3 is 1. In this instance, the data in all the registers 502, 506, 510, 522, 526, and 530 are valid, and the data in registers 506 and 526 are simultaneously shifted into registers 510 and 530, respectively, and the data in registers 502 and 522 are simultaneously shifted into registers 506 and 526, respectively.

Figure 15A:
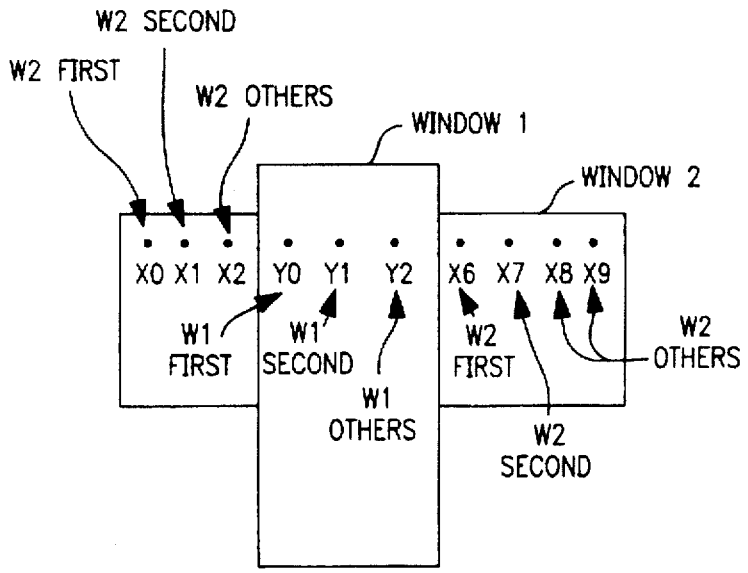
FIGS. 15*a*–15*b* are different sets of display windows used to illustrate the operation of the advance state machine in FIG. 6*a;*

FIGS. 15*a*–17 illustrate the operation of advance state machine 262 in FIG. 6*a*. FIG. 15*a* shows two overlapping display windows W1 and W2. For illustration purposes, when W1 and W2 overlap, W1 is on top of W2. FIG. 15*b* shows two windows W1 and W2 that do not overlap. FIG. 16 is a state diagram of advance state machine 262 in FIG. 6. FIG. 17 is a table describing the states shown in FIG. 16.

Now referring to FIG. 16, there are at least seven different states: an idle state, w1 first state, w1 second state, w1 others state, w2 first state, w2 second state, and w2 others state. When advance state machine 264 is in the idle state, the next state can be the idle, w1 first or w2 first state. If W1 is active, then the next state is W1 first. If W2 is active and W1 is inactive, then the next state is W2 first. If both W1 and W2 are inactive, then the next state is the idle state. Because W1 is placed on top of W2, in this example, even if both W1 and W2 are active, because W1 is on top of W2, the pixel data for W1 will be displayed instead of the pixel data for W2. Hence, if W1 is active regardless of whether W2 is active or inactive, advance state machine 264 will be in W1 first, W1 second or W1 others state rather than in W2 first, W2 second or W2 others state.

Advance state machine 264 is in the idle state when pixel points that are not on W1 or W2 (e.g., Gi, G2, G3, and G4 in FIG. 15*b*) are being displayed on display monitor 1036.

When advance state machine 264 is in W1 first, the next available states are the idle state if W1 and W2 are inactive, the W1 second state if W1 is active, and the W2 first state if W2 is active while W1 is inactive.

When advance state machine 264 is in the W1 second state, the next available states are the idle state if both W1 and W2 are inactive, the W1 others state if W1 is active, and the W2 first state if W2 is active and W1 is inactive.

When advance state machine 264 is in the W1 others state, the next possible states are the idle state if both W1 and W2 are inactive, the W1 others state if W1 is active, and the W2 first state if W2 is active and W1 is inactive.

When advance state machine 264 is in the W2 first state, the next possible states are the idle state if W1 and W2 are inactive, the W1 first state if W1 is active, and the W2 second state if W2 is active and W1 is inactive.

When advance state machine 264 is in the W2 second state, the next available states are the idle state if both W1 and W2 are inactive, the W1 first state if W1 becomes active, and the W2 others state if W2 is active and W1 is inactive.

Lastly, when advance state machine 264 is in the W2 others state, then the next available states are the idle state if both W1 and W2 are inactive, the W2 others state if W2 is active and W1 is inactive, and the W1 first state if W1 is active.

Figure 15B:
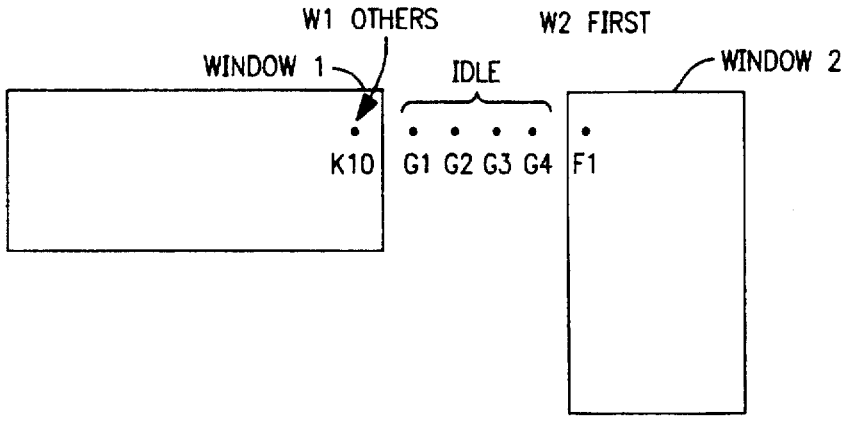

As shown in FIG. 15*a*, to display the pixel point X0, advance state machine 264 is in the W2 first state, to display the pixel point Xi, advance state machine 264 is in the W2 second state, and to display the pixel point X2, advance state machine 264 is in W2 others state. Advance state machine 264 is in various other states as indicated in FIG. 15*a* and 15*b*.

FIG. 17*a* shows the status of the control signals--MUX SEL 4 and REG ENBL 4—that are used to control registers 602 and 606 and mux 604 in horizontal prefetch buffer 109 in FIG. 11. MUX SEL 4 and REG ENBL 4 are the output signals of advance state machine 264. When MUX SEL 4 is 0, the data in register 602 can be shifted into register 606. If MUX SEL 4 is 1, then a new vertical data from vertical scaler 108 can be loaded into register 606. When REG ENBL 4 is 0, no new data is loaded into register 602 or 606, and registers 602 and 606 contain the old data. If, on the other hand, REG ENBL 4 is 1, then data can be loaded into registers 602 and 606.

For example, if MUX SEL 4 is 0, and REG ENBL 4 is 1, then the old data in register 602 is shifted into register 606, and new data from vertical scaler 108 is loaded into register 602. If MUX SEL 4 is 1, and REG ENBL 4 is 1, then new data from vertical scaler 108 is loaded into both registers 602 and 606. If MUX SEL 4 is 0 and REG ENBL 4 is 0, or MUX SEL 4 is 1 and REG ENBL 4 is 0, then no new data is loaded into register 602 or 606.

In FIG. 17*a*, NEWBYTE is 1 if the integer LSB of W1 horizontal counter 218 for the current cycle is different from the previous one and W1 is being displayed. NEWBYTE is also 1 if integer LSB of W2 horizontal counter 222 for the current cycle is different from the previous one, and W2 is being displayed.

To illustrate this, FIG. 17*b* shows an example of the contents of counter delay unit 226 in FIG. 6*a*. Each register of counter delay unit 226 includes the value of W1 horizontal counter (W1 HCtr) 218 or W2 horizontal counter (W2 HCtr) 222. After these values are stored into counter delay unit 226, during each clock cycle, counter delay unit 226 sends an integer LSB to advance state machine 262, and the fractional part to horizontal scaler 110 as a horizontal weight. During a clock cycle, if the contents of register 1 of counter delay unit 226 in FIG. 17*b* is outputted, then since the integer LSB of register 1 is the same as the integer LSB of register 0, NEWBYTE is 0. If, however, the contents of register 2 of counter delay unit is outputted, then since the integer LSB of register 2 is different from the integer LSB of register 1, NEWBYTE becomes 1. NEWVBYTE becomes also 1 when the contents of register 6 are outputted from counter delay unit 226. This is because the integer LSB of register 6 (0) is different from the integer LSB (1) of register 5.

The status of the control signals--MU SEL 4 and REG FNBL 4—are described below with reference to FIG. 17*a*. In the idle state, all signals (MUX SEL 4 and REG ENBL 4) are inactive. For example, while displaying the pixel points G1–G4, both MUX SEL 4 and REG ENBL 4 will be 0.

In the W1 first state, MUX SEL 4 and REG ENBL 4 are 1. For instance, to display the pixel point Y0 in FIG. 15*a*, since MUX SEL 4 and REG ENBL 4 are 1, new data from vertical scaler 108 will be loaded into registers 602 and 608.

In the W1 second state, MUX SEL 4 is 0 and REG ENBL 4 is 1. For example, to display the pixel point Y1 in FIG. 15*a*, the old data in register 602 will be shifted into register 606, and new data from vertical scaler 108 will be loaded into register 602.

In the W1 others state, MUX SEL 4 is 0, and REG ENBL 4 is NEWBYTE. For example, to display the pixel point Y2 in FIG. 15*a*, if new data is needed, then NEWVBYTE will be 1, the old data in register 602 will be shifted into register 606, and the new data will be loaded into register 602. If, however, no new data is needed to display the pixel point Y2, then the registers 602 and 606 will keep the old data.

In the W2 first state, MUX SEL 4 is 1 and REG ENBL 4 is 1. In the W2 second state, M-UX SEL 4 is 0 and REG ENBL 4 is 1. In the W2 others state, MUX SEL 4 is 0, and REG ENBL 4 is NEWBYTE. The operation of the registers 602 and 606 and mux 604 for W2 first, W2 second and W2 others are similar to those of W1 first, W1 second, and W1 others except that data for W2 instead of W1 will be processed.

Figure 18:
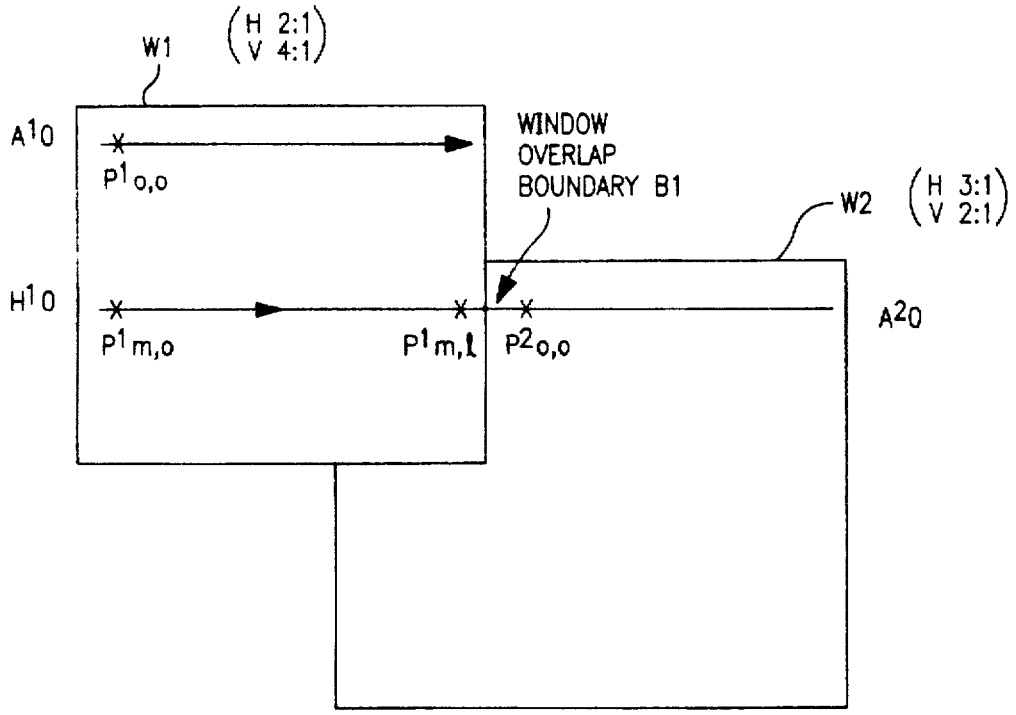
FIG. 18 is another set of overlapping windows.

The operation of scaling and displaying images on multiple windows is described with reference to FIGS. 5, 6*a*, 10, 11, and 18–22*d*. For illustration, two overlapping windows (W1 and W2) are shown in FIG. 18 that can be displayed on display monitor 1036. W1 displays a first scaled image, and W2 displays a second scaled image. Data for W1 and W2 prior to scaling is stored in Y memory 102*a* in FIG. 5. Because there are two windows, Y memory 102*a* is divided into two halves—102*aa* and 102*ab*. Typically, memory portion 102*aa* contains the bitmap data for W1, and memory portion 102*ab* contains the bitmap data for W2. Memory portions 102*aa* and 102*ab* each receive one scan line worth of bitmap data at a time, and stores two scan line worth of bitmap data. If a horizontal line on display monitor 1036 is 352 pixels wide, then since we have two display windows, each of memory portions 102*aa* and 102*ab* contains at most 176 bitmap data per scan line.

Figure 19:
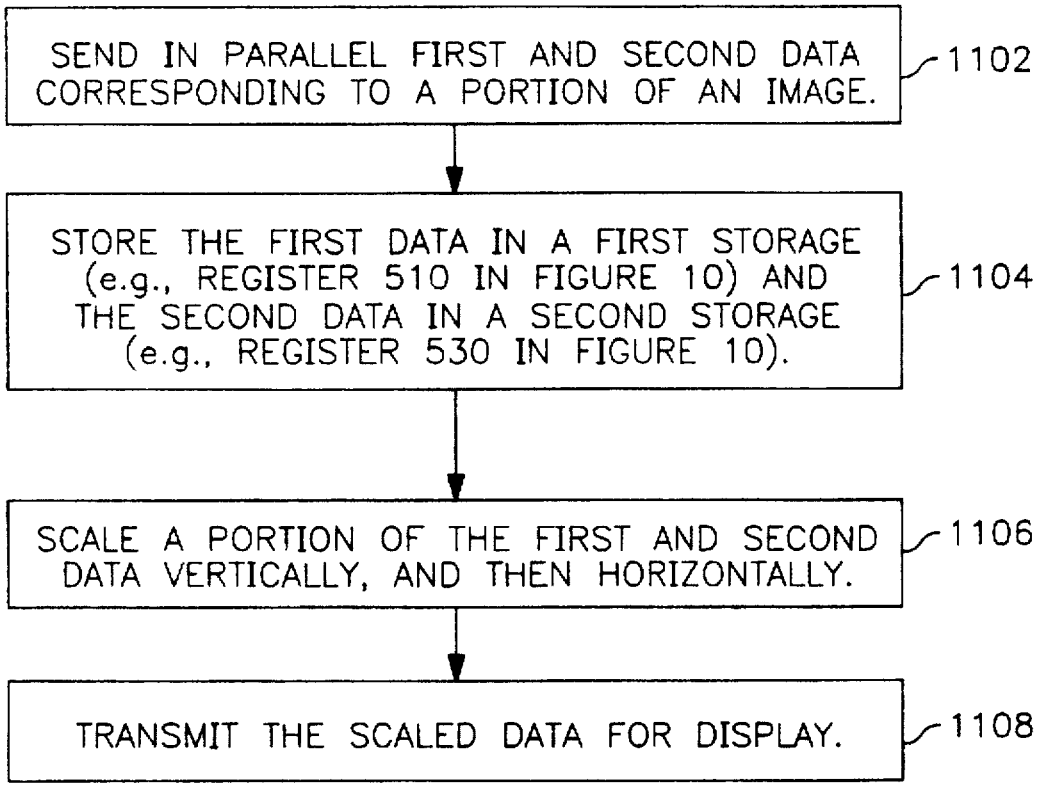
FIG. 19 is a process flow diagram of scaling and displaying an image on a display window.

FIG. 19 illustrates a typical process flow diagram of scaling and displaying an image on a display window. At step 1102, Y memory 102*a* sends in parallel first and second bitmap data corresponding to a portion of an image such as the one that is to be displayed on W1 in FIG. 18 through LB1 104 and LB0 106. The first and second bitmap data are from two different scan lines. At step 1104, the first data is stored into a first storage (e.g., register 510 in FIG. 10) and the second data is stored into a second storage (e.g., register 530 in FIG. 10). At step 1106, a portion of the first and second data is scaled vertically and then horizontally. At step 1108, the scaled data is transmitted to video merging system 1034 for display on display monitor 1036.

Figure 21A:
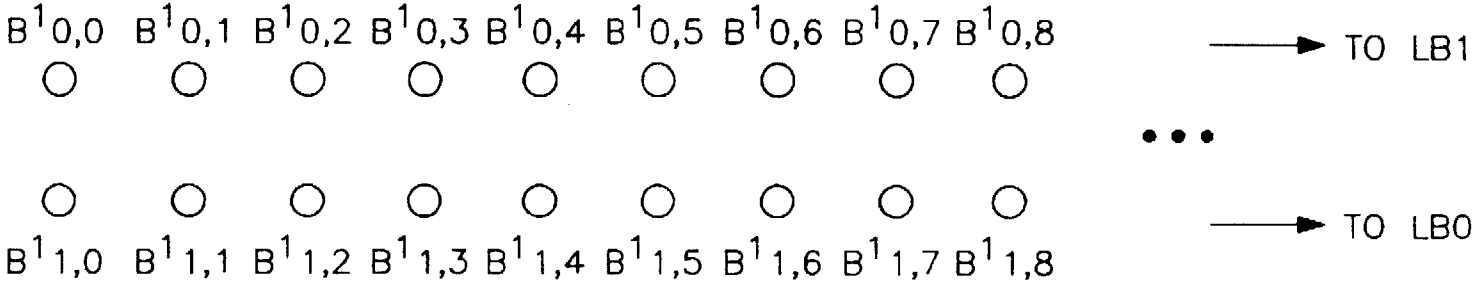
FIG. 21*a* illustrates an example of bitmap data to be vertically and horizontally scaled according to the present invention.
Figure 21B:
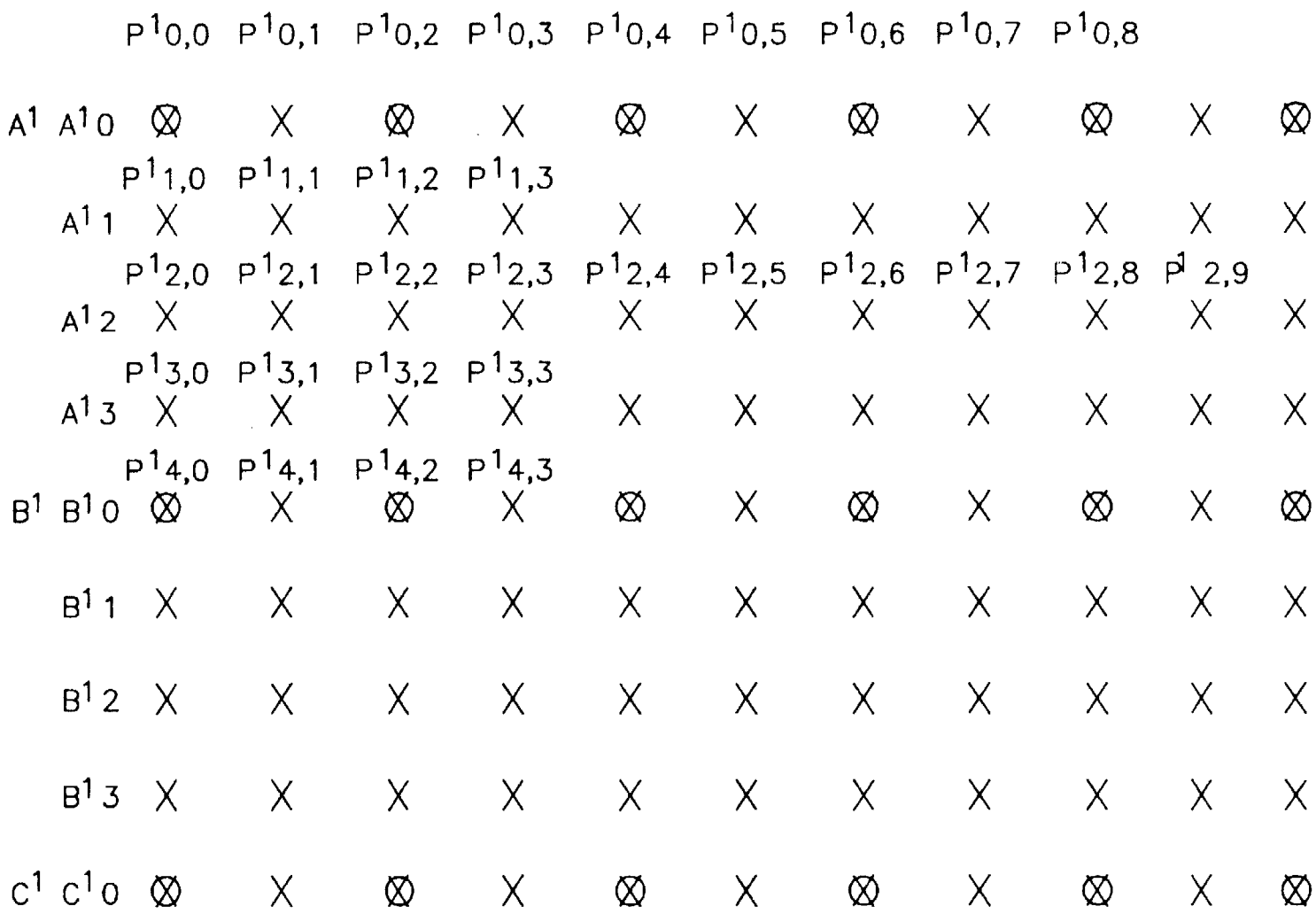
FIG. 21*b* illustrates an example of scaled pixel data as displayed on a window according to the present invention.

Referring to FIGS. 6*a*, 10, 11, 18, 20, 21*a*, 21*b*, and 22*a*–22*d*, examples are provided below to describe scaling and displaying images on display windows. A portion of the bitmap data that is stored in memory portion 102*aa* is shown in FIG. 21*a*, and a portion of the pixel data to be displayed on W1 is shown in FIG. 21*b*. In FIG. 21*b*, the pixels where O and X coincide have pixel values that are identical to the values of their corresponding bitmap data in FIG. 21*a*. In this example, the vertical scaling factor used is 4:1, and the 1 0 horizontal scaling factor is 2:1. Also, in this example, registers 502, 506, 510, 522, 526 and 530 in FIG. 10 each contain up to 4 bytes of bitmap data from Y memory 102*a*. Registers 514 and 542 each contain 1 byte of bitmap data. In addition, registers 602, 606 and 618 each contain 1 byte of data. It should be noted that although in this example, a scaling factor of 4:1 vertically and 2:1 horizontally is chosen, different scaling factors can be used, and different number of bytes can be stored in each of the registers.

To display the first image on W1, a scan line $A^1$0 is displayed first. At this point, memory portion 102*aa* contains bitmap data shown in FIG. 21*a*. The data to be displayed on W1 is shown in FIG. 21*b*. To display the first image on W1, vertical and horizontal DDA control & counter unit 116 receives a window 1 active signal from raster control unit 1040, as shown in FIG. 6*a*.

FIG. 20 illustrates the various values that are contained in W1 vertical delta register (W1 VDelta) 202, W1 vertical counter (W1 VCtr) 204, W1 horizontal delta register (W1

HDelta) 216, and W1 horizontal counter (W1 HCtr) 218. Each of the registers (202, 206, 216 and 218) contains upper bits dedicated for integers, and lower bits dedicated for fractional parts, as shown in FIGS. 6*b* and 20. Since the vertical scaling factor is 4:1 (i.e., enlarging the bitmap data four times vertically), W1 VDelta 202 contains 0 for the integer portion, and ¼ for the fractional part. Since the horizontal scaling factor is 2:1 (i.e., enlarging the bitmap data twice horizontally), W1 HDelta 216 contains 0 for the integer part, and ½ for the fractional part. The values of W1 VDelta 202 and W1 HDelta 216 stay constant for the entire image being displayed on W1.

Mux's 210 and 224 in FIG. 6*a* select W1 VCtr 204 and W1 HCtr 218, respectively, while the first image is displayed on W1. Thus, to display W1, the vertical weights for vertical scaler 108 is provided by W1 VCtr 204 and horizontal weights for horizontal scaler 110 is provided by W1 HCtr 218. As noted earlier, the horizontal weights are delayed by counter delay unit 226. In the following discussion, the values of W1 HCtr 218 are actually contained in counter delay unit 226.

Referring to FIGS. 18, 21*a* and 21*b*, to display p10,0, vertical prefetch buffer 107 receives 4 bytes of data ($B^1$0,0, $B^1$0,1, $B^1$0,2 and $B^1$0,3) through LB1 and 4 bytes ($B^1$1,0, $B^1$,1, $B^1$1,2, $B^1$1,3) through LB0. The bitmap data ($B^1$0,0, $B^1$0,1, $B^1$0,2, and $B^1$0,3) are stored into register 510 in FIG. 10, and the bitmap data ($B^1$,0, $B^1$,1, $B^1$1,2, and $B^1$1,3) are stored into register 530 in FIG. 10. When MUX SEL A 231 is 0, register 514 receives the first bitmap data $B^1$0,0, and register 542 receives the bitmap data $B^1$1,0. W1 VCtr 204 contains 0,0, and W1 HCtr 218 contains 0,0.

W1 VCtr 204 provides the vertical weights to wgt A 516 and wgt B 544 in FIG. 10. The value of wgt B 544 is the fractional part of W1 VCtr 204 while the value of wgt A 516 equals (1-wgt B). Since W1 VCtr 204 contains 0 in its fractional part, wgt A 516 is 1, and wgt B 544 is 0. Thus, register 518 contains the value of bitmap data $B^1$0,0 while register 546 contains 0.

The output of vertical scaler 108 will be the value of $B^1$0,0. Because this is the first data point since W1 became active (the W1 first state in FIGS. 16 and 17), MUX SEL 4 is 1 and REG ENBL 4 is 1. Hence, the value of $B^1$0,0 is stored into both registers 602 and 606 in FIG. 11. W1 HCtr 218 provides, through mux 224 and counter delay unit 226, the horizontal weights to wgt A 608 and wgt B 612 in FIG. 11. The value of wgt B 612 is the fractional part of W1 HCtr 218 while the value of wgt A 608 equals (1-wgt B). Since W1 HCtr 218 contains 0 in its fractional part, wgt A 608 is 1, and wgt B 612 is 0. Thus, register 610 contains the value of bitmap data $B^1$0,0, while register 614 contains 0. Accordingly, register 618 which is the output of horizontal scaler 110, contains the value of $B^1$0,0. Finally, an output that contains the value of $B^1$0,0 is displayed at $P^1$0,0 on W1.

Next, to display pixel data $P^1$0,1, MUX SEL A 231 becomes 1. Accordingly, register 514 contains bitmap data $B^1$0,1, and register 542 contains bitmap data $B^1$1,1. Because the wgt A 516 is 1 and wgt B 544 is 0, the output of vertical scale 108 is the value of data $B^1$0,1. Since $P^1$0,1 is in the W1 second state (See FIGS. 16 and 17), MUX SEL 4 is 0 and REG ENBL 4 is 1. Hence, the old data in register 602 which is the value of data $B^1$0,0 is shifted into register 606, and a new data, the value of data $B^1$0,1 is loaded into register 602 in FIG. 10. Since the fractional part of W1 HCtr 218 is ½ (FIG. 20), wgt A 608 contains ½, and wgt B 612 contains ½. Thus, the output of horizontal scaler 110 is the average value of $B^1$0,0 and $B^1$0,1. This output is displayed as pixel $P^1$0,1 on W1.

To display pixel data P10,2, since W1 HCtr 218 contains 1 in its integer portion, MUX SEL 4 is 0 and REG ENBL 4 is 1, and the data in register 602 (the value of data $B^1$0,1) is shifted into register 606. Since W1 HCtr 218 contains 0 in its fractional part, the value of wgt A 608 is 1 while the value of wgt B 612 is 0. Thus, the output of horizontal scaler 110 is equal to the value of data $B^1$0,1.

Next, to display pixel data P10,3, MUX SEL A 231 becomes 2, and register 514 now contains data $B^1$0,2, and register 542 contains data $B^1$1,2. Since the fractional part of W1 VCtr is 0, wgt A 516 is 1, and wgt B 544 is 0. The output of vertical scaler 108 is $B^1$0,2 which is stored into register 602. Since the fractional part of W1 HCtr 218 is ½, wgt A 608 is ½ and wgt B 612 is ½. Hence, the output of horizontal scaler 110 is the average value of $B^1$0,1 and $B^1$0,2. This output is displayed as pixel $P^1$0,3 on W1.

To display the rest of the pixels along scan line $A^1$0 on W1, vertical prefetch buffer 107, vertical scaler 108, horizontal prefetch buffer 109, and horizontal scaler 110 proceed to process the bitmap data in a similar manner, except that when the data in register 510 and 530 is used up, it needs to be replenished.

For example, before pixel data P10,7 can be displayed, registers 510 and 530 need to be reloaded with a new set of data from memory portion 102*aa*. The bitmap data $B^1$0,4, $B^1$0,5, $B^1$0,6 and $B^1$0,7 will be available on line LB1. The bitmap data $B^1$1,4, $B^1$1,5, $B^1$1,6, and $B^1$1,7 will be available on line LB0. The data from LB1 will be stored into register 510 while the data from LB0 will be stored into register 530. The data will be processed in a manner similar to the operations described above.

After scan line $A^1$0 is completed, the next scan line $A^1$1 is displayed on W1. To display the pixel points on scan line $A^1$1, vertical prefetch buffer 107 needs to reload bitmap data $B^1$0,0, $B^1$0,1, $B^1$0,2, and $B^1$0,3 through line LB1 into register 510, and bitmap data $B^1$1,0, $B^1$1,1, $B^1$1,2 and $B^1$1,3 through line LB0 into register 530. Thus, the bitmap data shown in FIG. 21*a* will be reloaded into vertical prefetch buffer 107 for scan line $A^1$1 as it was done for scan line $A^1$0. The only difference between scan line $A^1$0 and scan line $A^1$1 is that the fractional part of W1 VCtr 204 now contains ¼ instead of 0.

Subsequently, the pixel points along scan lines $A^1$2 and $A^1$3 will be displayed in a similar manner. When the pixel points are displayed along scan line $A^1$2, the value in W1 VCtr 204 will be 0 for the integer part, and ½ for the fractional part. To display scan line $A^1$3, the value in W1 VCtr 204 will be 0 for the integer part, and ¾ for the fractional part.

Before a scan line $B^1$0 is displayed on W1, raster control unit 1040 instructs DMA 1030 to load in a new scan line into memory portion 102*aa*. The new bitmap data will replace the bitmap data $B^1$0,0, $B^1$0,1, etc. The new bitmap data will be provided to vertical prefetch buffer 107 through LB1. While scan lines $A^1$0–$A^1$3 in FIG. 21*b* are displayed, the value of wgt B 544 is the fractional part of W1 VCtr 204, and the value of wgt A 516 is (1-wgt B 544). In addition, the value of wgt B 612 is the fractional part of W1 HCtr 218, while the value of wgt A 608 is (1-wgt B 612). For scan lines $B^1$0–$B^1$3 in FIG. 21*b*, the opposite is true. Wgt A 516 contains the value of the fractional portion of W1 VCtr 204 while weight wgt B 544 contains (1-wgt A 516). Also, wgt A 608 contains the value of the fractional portion of W1 HCtr 218 while weight wgt B 612 contains (1-wgt A 608). Each of the subsequent scan lines is displayed on W1 in a manner similar to that described above.

When only one display window is active, and the pixel data being displayed is not near the edge of a window overlapping boundary (e.g., $B^1$ in FIG. 18) as described above, only registers 510 and 530 are used to load data from LB1 and LB0. However, near the edge of the window overlapping boundary, not only registers 510 and 530 but also registers 506 and 526 are used to receive data. To display scan line $H^1$0, memory portion 102*aa* contains bitmap data such as those shown in FIG. 22*a*. Using the bitmap data shown in FIG. 22*a*, the pixel points $P^1$m,0, $P^1$m,1 . . . $P^1$m,1 (FIG. 22*c*) along scan line $H^1$0 can be displayed on W1. The bitmap data for W1 shown in FIG. 22*a* occupy registers 510 and 530 in FIG. 10. To display some of the pixel points along $A^2$0 on W2 ($P^2$0,0, $P^2$0,1, etc.), at least the first set of data ($B^2$0,q, $B^2$0,q+1, $B^2$0,q+2, $B^2$0,q+3, $B^2$1,q, $B^2$1,q+1, $B^2$1,q+2, and $B^2$1,q+3 in (FIG. 22*b*) from memory portion 102*ab* for W2 is loaded into registers 506 and 526 because they are near the edge of the window overlapping boundary (i.e., $B^1$). Such an operation is necessary because, in this example, while memory 102*aa*'s access frequency is 50 MHz, the other components in display scaler 1032*a* operate at 80 MHz. After the bitmap data for the pixel point $P^1$m,1 is loaded into registers 510 and 530, the bitmap data for pixel point $P^2$0,0 needs to be fetched during the next read operation and loaded into registers 506 and 526 so that there is no interruption in displaying the pixel points on display monitor 1036.

Figure 22A:
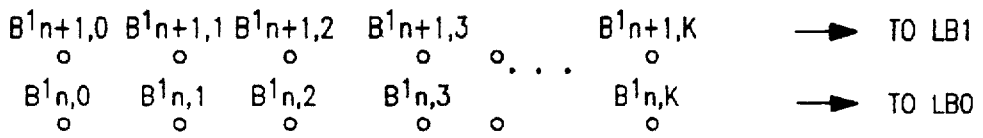
FIG. 22*a* illustrates another example of bitmap data to be vertically and horizontally scaled according to the present invention.
Figure 22B:
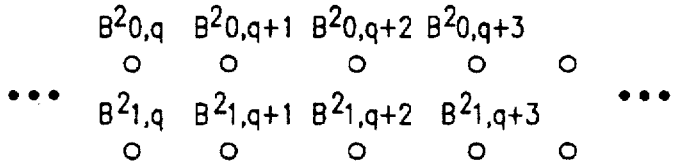
FIG. 22*b* illustrates yet another example of bitmap data to be vertically and horizontally scaled according to the present invention.
Figure 22D:
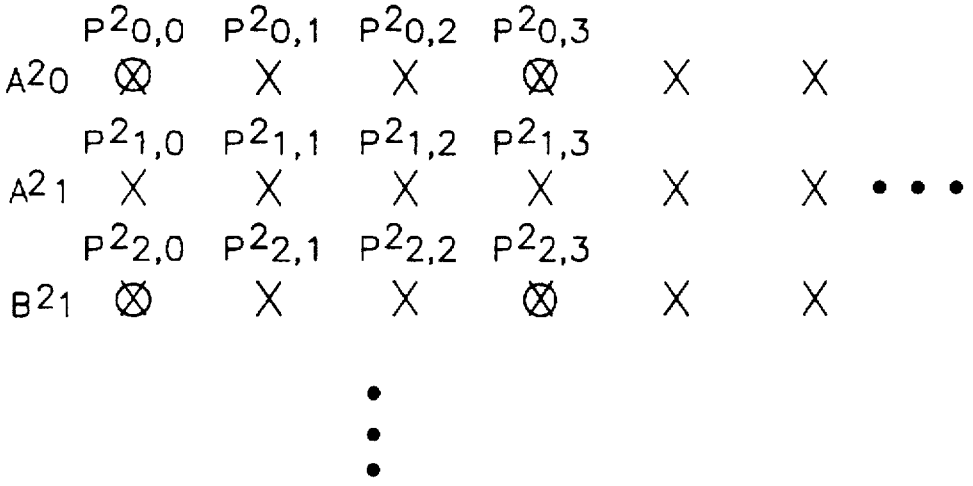
FIG. 22*d* illustrates yet another example of scaled pixel data as displayed on a window according to the present invention.
Figure 22C:
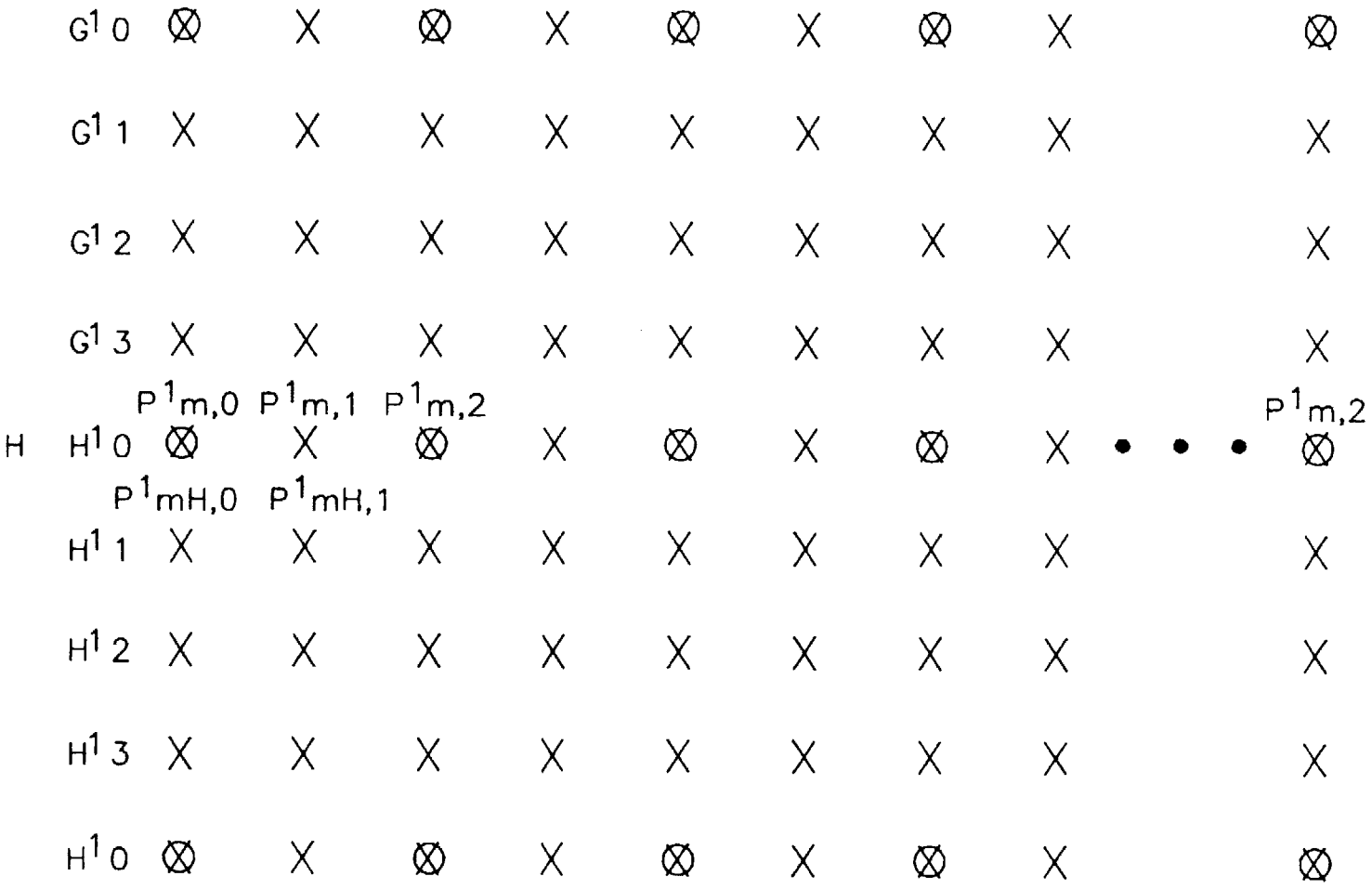
FIG. 22*c* illustrates another example of scaled pixel data as displayed on a window according to the present invention.

While FIG. 22*b* shows the bitmap data for W2 contained in memory portion 102*ab*, FIG. 22*d* shows the pixel points that are to be displayed on W2. In this instance, the scaling factor for W2 is 2:1 vertically and 3:1 horizontally. While pixel point $P^2$0,0 takes the value of bitmap data $B^2$0,q, pixel point $P^2$0,3 takes the value of the bitmap data $B^2$0,q+1, the pixel point $P^2$2,0 takes the value of the bitmap data $B^2$1,q, and the pixel point $P^2$2,3 takes the value of the bitmap data $B^2$1,q+1. The pixel points ($P^2$0,1, $P^2$0,2, $P^2$1,0, $P^2$1,1, $P^2$1,2, $P^2$1,3, $P^2$2, 1, and $P^2$2,2) between the pixel points $P^2$0,0, $P^2$0,3, $P^2$2,0 and $P^2$2,3 have scaled values so that the scaling becomes continuous both horizontally and vertically. For instance, the value of the pixel point p20,1 is the sum of ⅔ of the value of $P^2$0,0 and ⅓ of $P^2$0,3. The value of the pixel point $P^2$0,2 is the sum of ⅓ of $P^2$0,0 and ⅔ of $P^2$0,3. In addition, the value of the pixel point $P^2$1,0 is the average of $P^2$0,0 and $P^2$2,0 and the value of $P^2$1,3 is the average of $P^2$0,3 and $P^2$2,3.

FIGS. 23–26*b* illustrate the vertical and horizontal scaling of bitmap data according to one embodiment of the present invention where one of the display windows is very narrow. Because the memory access frequency is much slower than the operating frequency of the rest of the circuits in display scaler 1032*a*, and W1 is very narrow, all of the six registers (502, 506, 510, 522, 526 and 530 in FIG. 10) in vertical prefetch buffer 107 are utilized in this instance.

Figure 23:
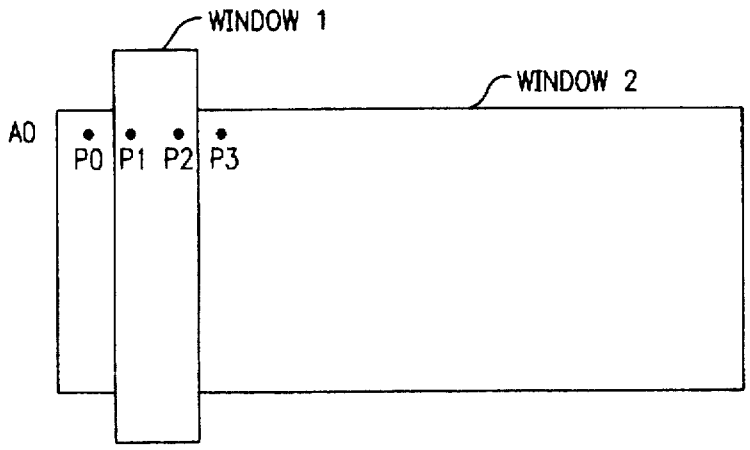
FIG. 23 is a set of overlapping windows where one of the windows is 2-pixels wide.
Figure 24A:
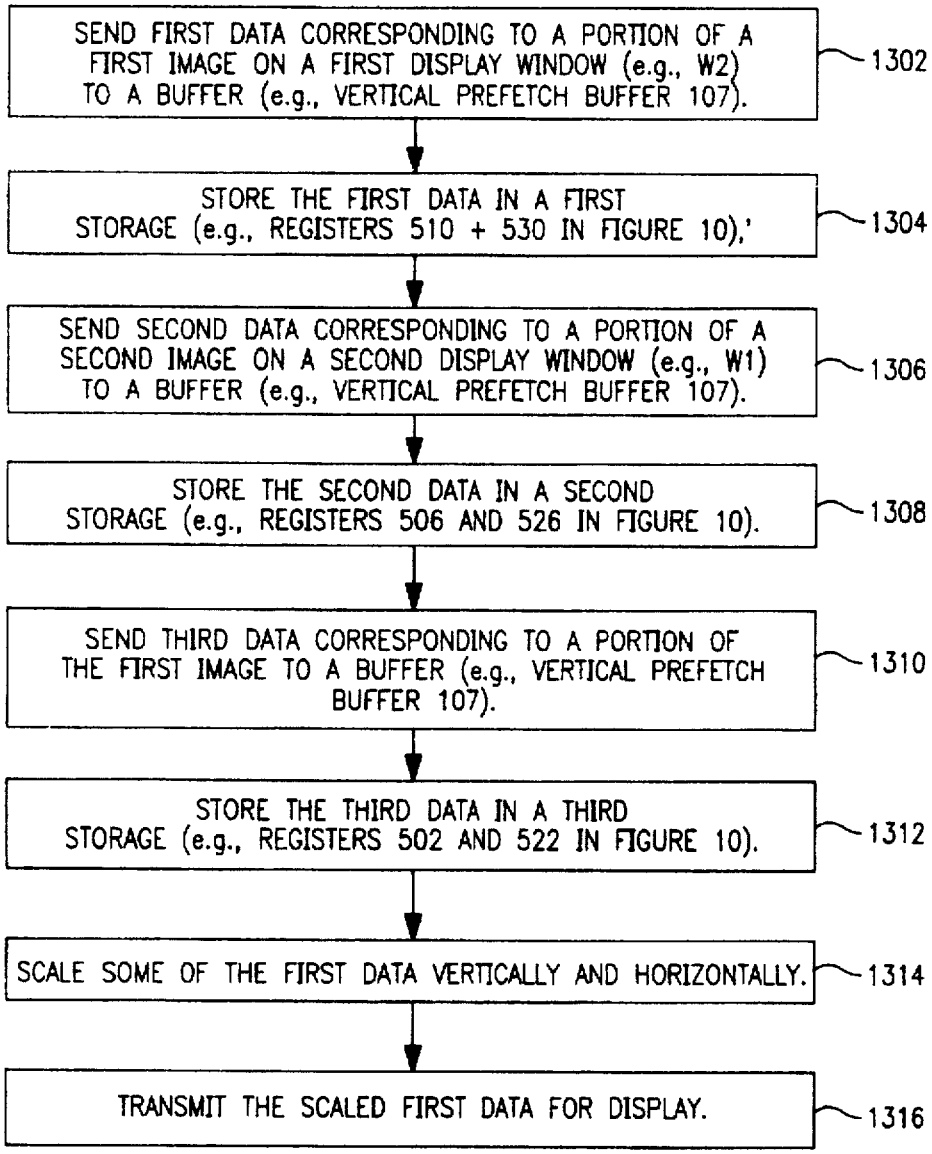
FIGS. 24*a* and 24*b* present a process flow diagram of scaling and displaying images on the two overlapping display windows shown in FIG. 23.
Figure 24B:
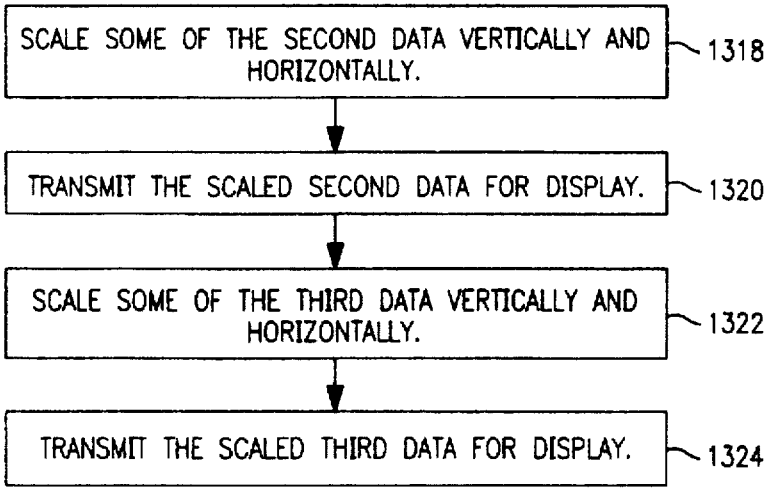
Figure 26A:
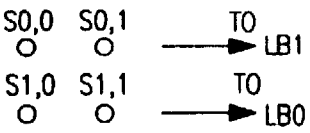
FIG. 26*a* illustrates an example of bitmap data contained in memory portion 102*aa*.
Figure 26B:
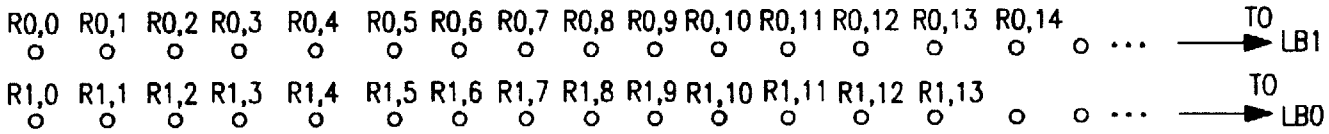
FIG. 26*b* illustrates an example of bitmap data contained in memory portion 102*ab*.

FIG. 24 shows a process flow diagram of scaling and displaying the first image on a first display window, and a second image on a second display window where the second display window overlaps the first display window and the second display window is very narrow. At step 1302, the first data corresponding to a portion of a first image on a first display window (e.g., W2) is sent by memory 102*a* so that the data appear along LB1 104 and LB0 106 of FIG. 5. For illustration purposes, it is assumed that memory 102*a*'s access frequency is 50 MHz, and the rest of the circuits in display scaler 1032*a* operate at 80 MHz. In addition, it is assumed that each of the six registers (502, 506, 510, 522, 526 and 530) in vertical prefetch buffer 107 can contain four bytes of bitmap data. The first data will come from memory portion 102*ab* to display the pixel point P0 in FIG. 23. FIG. 26*a* shows the bitmap data contained in memory portion 102*aa* for W1, and FIG. 26*b* shows the bitmap data contained in memory portion 102*ab* for W2. The first data will consist of four bytes of bitmap data from a first scan line (e.g., R0,0, R0,1, R0,2, and R0,3, in FIG. 26*b*) and four bytes from a second scan line (e.g., R1,0, R1,1, R1,2, R1,3, and R1,4).

Figure 25:
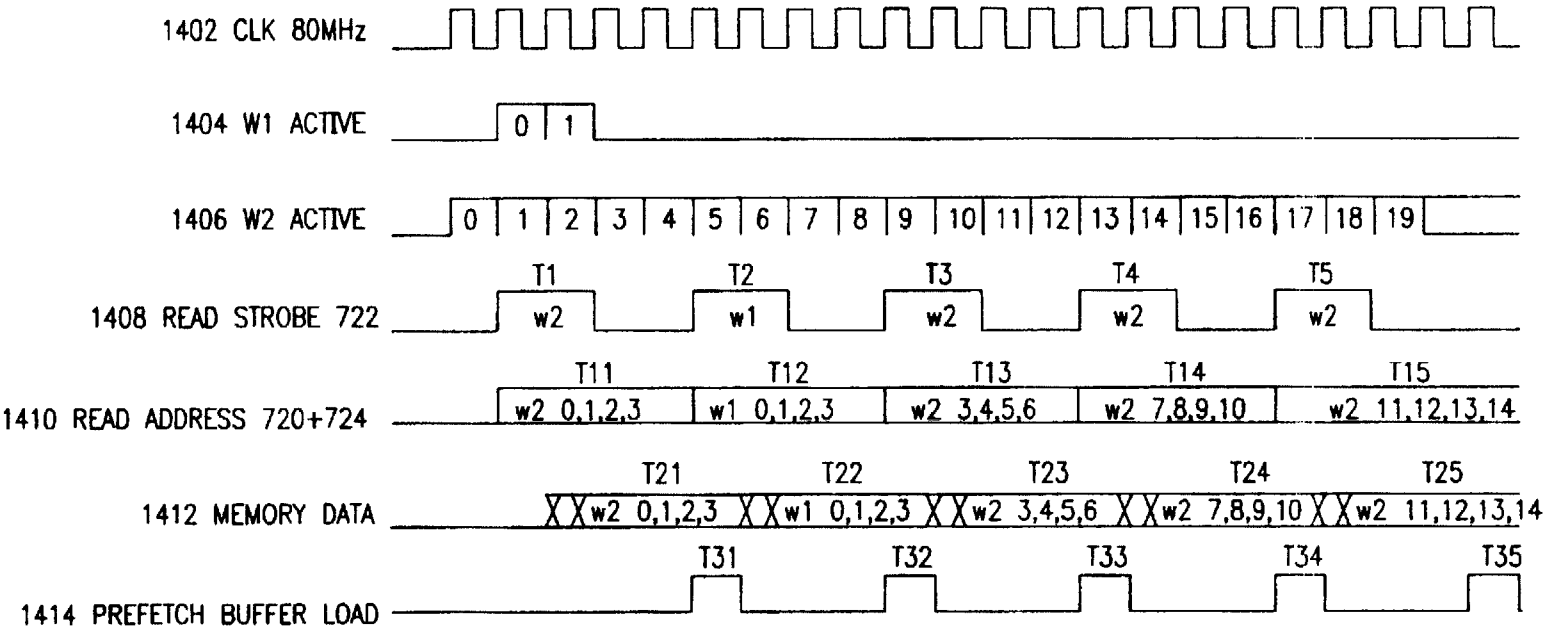
FIG. 25 is a timing diagram of displaying images on two overlapping windows shown in FIG. 23.

FIG. 25 illustrates a timing diagram of displaying images on overlapping windows shown in FIG. 23. A clock 1402 indicates the clock frequency of display scaler 1032*a*. It is also assumed that the scaling factor is 1:1 for both vertical and horizontal dimensions for simplicity. W1 is only active for pixel data 0 and 1. W2 is active for pixel data from 0 to the end of the scan line A0 in FIG. 23. FIG. 25 also shows when read strobe signal 722 is active. Read strobe signal 722 became active (e.g., T1, T2, T3, T4, and T5) to begin a read operation (see FIG. 12). In addition, read address signals 720 and 724 become active to send the appropriate addresses from read state machine 302 in FIG. 7 to memory 102*a* in FIG. 5. A memory data line 1412 indicates when the bitmap data is available at lines LB0 and LB1. A prefetch buffer load line 1414 indicates when the bitmap data on LB1 and LB0 is loaded into registers in vertical prefetch buffer 107. To execute step 1302 in FIG. 24*a*, read strobe signal 722 becomes active during period T1, the read address signals 720 and 724 become active during period T11 and send the appropriate address for the first four bytes of the first scan line (e.g., R0,0, R0,1, R0,2, and R0,3, in FIG. 26*b*), and the first four bytes of the second scan line (e.g., R1,0, R1,1, R1,2, and R1,3) stored in memory portion 102*ab*. These eight bytes are used to display pixel data 0–3 of W2. Finally, the first data appears on LB1 104 and LB0 in FIG. 5 during period T21.

At step 1304 in FIG. 24*a*, the first data is stored into a first storage (e.g., registers 510 and 530 in FIG. 10). As indicated by prefetch buffer load line 1414 in FIG. 25, at T31, the first data on LB1 is placed into register 510 and the first data on LB0 is placed into register 530 in FIG. 10.

At step 1306, memory portion 102*aa* sends second data corresponding to a portion of a second image on a second display window (e.g., W1). In FIG. 25, read strobe signal 722 becomes active during period T2 for W1. Read address signals 720 and 724 become active during period T12 and send the appropriate addresses to memory portion 102*aa*. Subsequently, the first four bitmap data of the first scan line (e.g., S0,0, S0,1, and the next two bytes) in FIG. 26*a* where the next two bytes are not part of W1 data becomes available at LB1, and the first four bitmap data of the second scan line (e.g., S1,0, S1,1, and the next two bytes) becomes available at LB0 during period T22. At step 1308, the second data is stored into a second storage (e.g., registers 506 and 526 in FIG. 10). This occurs at T32.

At step 1310, memory portion 102*ab* sends third data corresponding to a portion of the first image. Read strobe signal 722 becomes active during period T3 in FIG. 25. Read address signals 720 and 724 become active during period T13 and send the appropriate addresses of the bitmap data R0,3, R0,4, R0,5, and R0,6 and the bitmap data R1,3, R1,4, R1,5, and R1,6 to memory portion 102*ab*. At period T23, the bitmap data from memory portion 102*ab* becomes available at LB1 and LB0. At step 1312, the third data are stored into a third storage (e.g., registers 502 and 522 in FIG. 10). In FIG. 25, during period T33, the bitmap data on LB1 and LB0 is loaded into registers 502 and 522, respectfully.

At step 1314, some of the first data (e.g., R0,0 and R1,0) are scaled vertically and horizontally using elements such as vertical scaler 108, horizontal prefetch buffer 109 and horizontal scaler 110. At step 1316, the scaled first data is transmitted for display on W2. Hence, the pixel point P0 is displayed on W2 in FIG. 23. Because only the pixel point P0 is displayed, only the bitmap data R0,0 and R1,0 are used, and the remaining bitmap data (R0,1, R0,2, R0,3, R1,1, R1,2, and R1,3) that are stored in registers 510 and 530 will be discarded.

At step 1318, some of the second data are scaled vertically and horizontally using elements such as vertical scaler 108, horizontal prefetch buffer 109 and horizontal scaler 110. To display the pixel points P1 and P2, the bitmap data that was stored in 506 and 526 is shifted into registers 510 and 530, and subsequently scaled. When the data in registers 506 and 526 is shifted into registers 510 and 530, it replaces the old data (R0,0, R0,1, R0,2, R0,3, R1,0, R1,1, R1,2, and R1,3) that was in registers 510 and 530. Although registers 506 and 526 each has 4 bytes of data, because W1 only requires two pixel points (e.g., P1 and P2) to be displayed, the last two bytes of the four are not used. At step 1320, the scaled second data is transmitted for display.

At step 1322, some of the third data is scaled vertically and horizontally. At step 1324, the scaled third data is transmitted for display. To display pixel data P3, the bitmap data that was stored in registers 502 and 522 is shifted into registers 506 and 526 and then to registers 510 and 530, respectively. After the pixel point P3 is displayed on W2, because there is no more window overlapping boundaries throughout the scan line A0, the bitmap data from memory 102*ab* for W2 will be subsequently loaded into registers 510 and 530 as the bitmap data in those registers is used up to display the pixel points on W2.

According to one embodiment of the present invention, display scaler 1032*a* is divided into the various blocks as shown in FIG. 5 which include the components and devices shown in FIGS. 7–11. It should be noted that in other embodiments, a display scaler may be divided into different blocks while incorporating the same or similar components and devices as those in FIGS. 7–11. In those instances, the components and devices may reside in the blocks that are different from those presently shown in FIG. 5.

For example, in FIG. 6*a*, mux select A delay unit 200 may reside in vertical prefetch buffer 107, mux 210 and counter select delay unit 212 may reside in vertical scaler 108, advance block 264 may reside in horizontal prefetch buffer 109, counter delay unit 226 and mux 224 may reside in horizontal scaler 110, and shift prefetch delay unit 248 may reside in prefetch buffer control unit 112 instead of being placed in vertical and horizontal DDA control & counter unit 116.

In addition, the entire vertical prefetch buffer 107 may be a part of Y memory 102*a*. Also, registers 514 and 542 in FIG. 10 may reside in vertical scaler 108 instead of being in vertical prefetch buffer 107. It should be noted that these examples described above are for illustration purposes only, and there may be numerous other ways to place the components and devices.

While the present invention has been particularly described with reference to the various figures and embodiments, it should be understood that these are for illustration only and should not be taken as limiting the scope of the invention. Many changes and modifications may be made to the invention, by one having ordinary skill in the art, without departing from the spirit and scope of the invention.

What is claimed is:

1. A display scaler comprising:

a memory for sending data;

a first variable length buffer coupled to said memory for receiving said data from said memory;

a first scaler coupled to said first buffer for scaling said data;

a buffer controller coupled to said first buffer for controlling said first buffer;

a memory controller coupled to said memory for controlling sending of said data from said memory to said first variable length buffer; and a main display controller coupled to said first scaler, said buffer controller, and said memory controller for sending control signals to said first scaler, said buffer controller, and said memory controller.

2. A display scaler according to claim 1 further including a second buffer for receiving said scaled data from said first scaler; and a second scaler for scaling said scaled data in a second direction wherein said main display controller is coupled to said second scaler, and wherein said first scaler is for scaling said data in a first direction.

3. A display scaler according to claim 2, wherein said first buffer includes:

a third storage which contains third data from said memory;

a second storage which contains second data from said memory; and a first storage which contains first data from said memory.

4. A display scaler according to claim 3 further comprising a display monitor for displaying a first and a second display window, wherein said first data is used to display pixels on said first display window, said second data is used to display pixels on said second display window, and said third data is used to display pixels on said first display window.

5. A display scaler according to claim 2, wherein said second buffer includes:

a second storage for receiving first data or second data from said first scaler;

a first storage for receiving said first data from said first scaler or for receiving said second data from said second storage; and a multiplexer coupled between said first scaler and said first storage for selecting an input from said first scaler or from said second storage.

6. A display scaler according to claim 5, wherein one control signal enables both said first and second storages simultaneously.

7. A display scaler according to claim 2, wherein said second scaler includes:

means for receiving first and second outputs of said second buffer simultaneously;

means for simultaneously supplying a weight to said first output of said second buffer and a weight to said second output of said second buffer; and an adder for adding said weighted first and second outputs.

8. A display scaler according to claim 2, wherein said main display controller includes:

a main logic unit for sending outputs to said memory controller;

a first counter coupled between said main logic unit and said first scaler; and a second counter coupled between said main logic unit and said second scaler.

9. A display scaler according to claim 8, wherein said main display controller further includes:

a first delay unit coupled to said main logic unit for delaying a control signal from being sent to said buffer controller;

a second delay unit coupled to said main logic unit for delaying a control signal from being sent to said first buffer;

a third counter coupled between said main logic unit and said first scaler;

a first multiplexer for receiving inputs from said first and third counters and sending outputs to said first scaler;

a third delay unit coupled to said main logic unit for delaying a control signal from reaching said first multiplexer;

a fourth counter coupled between said main logic unit and said second scaler;

a second multiplexer for receiving inputs from said second and fourth counters; and a fourth delay unit for delaying an output from said second multiplexer from reaching said second scaler;

wherein said main logic unit includes:

a fifth delay unit for delaying a window active signal; and an advance memory controller for receiving inputs from said fifth delay unit and for sending outputs to said second buffer.

10. A display scaler according to claim 2, wherein said first variable length buffer is a variable length first-in-first-out prefetch buffer, said first scaler is a vertical scaler, and said second scaler is a horizontal scaler; and wherein said first direction is a vertical direction, and said second direction is a horizontal direction.

11. A display scaler according to claim 1, wherein said first buffer is coupled to said memory through dual lines.

12. A display scaler according to claim 1, wherein said first buffer includes:

a third storage coupled to said memory for receiving third data from said memory;

a second storage coupled to said memory and said third storage for receiving second data from said memory or for receiving said third data from said third storage; and a first storage coupled to said memory and said second storage for receiving first data from said memory, for receiving said second data from said second storage, or for receiving said third data from said third storage through said second storage.

13. A display scaler according to claim 12, wherein said first storage includes a first and a second register, said second storage includes a third and a fourth register, and said third storage includes a fifth and a sixth register, wherein said first register is coupled to said third register, and said third register is coupled to said fifth register, wherein said second register is coupled to said fourth register, and said fourth register is coupled to said sixth register, wherein said first and second registers are controlled together, said third and fourth registers are controlled together, and said firth and sixth registers are controlled together.

14. A display scaler according to claim 13, wherein said first register is for receiving a first portion of said first data while said second register is for receiving a second portion of said first data simultaneously, or said first register is for receiving a first portion of said second data from said third register while said second register is for receiving a second portion of said second data from said fourth register simultaneously, or said first register is for receiving a first portion of said third data from said fifth register through said third register while said second register is for receiving a second portion of said third data from said sixth register through said fourth register, wherein said third register is for receiving a first portion of said second data from said memory while said fourth register is for receiving a second portion of said second data simultaneously, or said third register is for receiving a first portion of said third data from said fifth register while said fourth register is for receiving a second portion of said third data from said sixth register simultaneously, wherein said fifth register is for receiving a first portion of said third data while said sixth register is for receiving a second portion of said third data simultaneously.

15. A display scaler according to claim 14, wherein said first portions of said first, second, and third data are received through a first line, wherein said second portions of said first, second, and third data are received through a second line.

16. A display scaler according to claim 13, wherein said first buffer further includes:

a first multiplexer coupled between said first and third registers for selecting an input from said memory or said third register;

a second multiplexer coupled between said second and fourth registers for selecting an input from said memory or from said fourth register;

a third multiplexer coupled between said third and fifth registers for selecting an input from said memory or from said fifth register;

a fourth multiplexer coupled between said fourth and sixth registers for selecting an input from said memory or from said sixth register;

a fifth multiplexer coupled to said first register for selecting an input among data in said first register;

a sixth multiplexer coupled to said second register for selecting an input among data in said second register;

a seventh register for receiving an output from said fifth multiplexer; and an eighth register for receiving an output from said sixth multiplexer.

17. A display scaler according to claim 16, wherein said first and second multiplexers are controlled together, said third and fourth multiplexers are controlled together, and said fourth and fifth multiplexers are controlled together.

18. A display scaler according to claim 13, wherein that said first buffer is a variable length buffer produces the following:

in a first mode, only said first and second registers are used, in a second mode, said first, second, third and fourth registers are used, and in a third mode, said first, second, third, fourth, fifth, and sixth registers are used, wherein said first mode occurs when said display scaler is used to display a first image on a first display window, wherein when said display scaler is used to display a second image on a second display window that overlaps the first display window along a single vertical window overlap boundary, said second mode occurs to store data for pixels to be displayed on said first and second display windows, wherein when said display screen is used to display said second image on said second display window that overlaps the first display window along multiple vertical window overlap boundaries, said third mode occurs to store data for pixels to be displayed on said first and second display windows.

19. A display scaler according to claim 12, wherein said first buffer further includes:

a first multiplexer coupled between said first and second storages for selecting an input from said memory or from said second storage;

a second multiplexer coupled between said second and third storages for selecting an input from said memory or from said third storage.

20. A display scaler according to claim 19, wherein said first buffer further includes:

a third multiplexer for selecting an input among data in said first storage; and a fourth storage for receiving an output from said third multiplexer.

21. A display scaler according to claim 1, wherein said first scaler includes:

means for supplying a first weight to a first output of said first buffer and a second weight to a second output of said first buffer simultaneously; and an adder for adding said weighted first and second outputs.

22. A display scaler according to claim 1, wherein said buffer controller includes:

a buffer counter; and a buffer logic unit for receiving inputs from said buffer counter, said memory controller, and said main display controller and for sending outputs to said first buffer.

23. A display scaler according to claim 1, wherein said memory controller includes:

first-in-first-out (FIFO) registers for receiving inputs from said main display controller; and a read memory controller for receiving inputs from said FIFO registers and for sending outputs to said memory and to said first buffer.

24. A display scaler according to claim 1, wherein said memory's access frequency is lower than the operating frequency of said first buffer, said first scaler, said buffer controller, said memory controller, or said main display controller.

25. A system for generating an image on a display monitor, said system comprising:

a main processor;

a video processor coupled to said main processor for compressing and decompressing data;

a video memory for storing said data; and a display scaler coupled to said video processor, said display scaler comprising:

a memory for sending bitmap data;

a first variable length buffer for receiving said bitmap data from said memory;

a first scaler for scaling said data in a first direction;

a buffer controller for controlling said first buffer;

a memory controller for controlling sending said bitmap data from said memory; and a main display controller coupled to said first scaler, said buffer controller, and said memory controller for sending control signals to said first scaler, said buffer controller, and said memory controller.

26. A system according to claim 25, wherein said display scaler further includes:

a second buffer for receiving said scaled data from said first scaler; and a second scaler for scaling said scaled data in a second direction wherein said main display controller is coupled to said second scaler.

* * * * *